US007798852B2

(12) United States Patent
Laurx et al.

(10) Patent No.: US 7,798,852 B2
(45) Date of Patent: Sep. 21, 2010

(54) MEZZANINE-STYLE CONNECTOR WITH SERPENTINE GROUND STRUCTURE

(75) Inventors: John Laurx, Aurora, IL (US); Peerouz Amleshi, Lisle, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/214,645

(22) Filed: Jun. 20, 2008

(65) Prior Publication Data

US 2009/0011645 A1 Jan. 8, 2009

Related U.S. Application Data

(60) Provisional application No. 60/936,383, filed on Jun. 20, 2007, provisional application No. 60/936,384, filed on Jun. 20, 2007.

(51) Int. Cl.
*H01R 13/648* (2006.01)

(52) U.S. Cl. ..... 439/607.08; 439/607.11

(58) Field of Classification Search ..... 439/607.08, 439/607.1, 607.11, 607.05
See application file for complete search history.

(56) References Cited

U.S. PATENT DOCUMENTS

| | | | | |
|---|---|---|---|---|
| 4,733,172 | A | 3/1988 | Smolley | |
| 4,973,273 | A | 11/1990 | DePriest | |
| 5,019,945 | A | 5/1991 | Smolley | |
| 5,795,191 | A * | 8/1998 | Preputnick et al. | 439/607.11 |
| 6,146,202 | A | 11/2000 | Ramey et al. | |
| 6,146,207 | A | 11/2000 | Mulot | |
| 6,328,602 | B1 | 12/2001 | Yamasaki et al. | |
| 6,350,134 | B1 | 2/2002 | Fogg et al. | |
| 6,379,188 | B1 | 4/2002 | Cohen et al. | |
| 6,471,548 | B2 | 10/2002 | Bertoncini et al. | |
| 6,540,559 | B1 | 4/2003 | Kemmick et al. | |
| 6,652,318 | B1 | 11/2003 | Winings et al. | |
| 6,692,272 | B2 | 2/2004 | Lemke et al. | |
| 6,743,057 | B2 | 6/2004 | Davis et al. | |
| 6,808,419 | B1 | 10/2004 | Korsunsky et al. | |
| 6,827,611 | B1 | 12/2004 | Payne et al. | |
| 6,843,687 | B2 | 1/2005 | McGowan et al. | |
| 6,863,543 | B2 | 3/2005 | Lang et al. | |
| 7,131,870 | B2 | 11/2006 | Whiteman, Jr. et al. | |

(Continued)

FOREIGN PATENT DOCUMENTS

| | | |
|---|---|---|
| EP | 0924812 | 6/1990 |

(Continued)

OTHER PUBLICATIONS

International Search Report for PCT/US2008/007741.

*Primary Examiner*—Hien Vu
(74) *Attorney, Agent, or Firm*—Stephen L. Sheldon

(57) ABSTRACT

A high speed connector with reduced crosstalk utilizes individual connector support frames that are assembled together to form a block of connector units in a vertical arrangement. Each such unit supports an array of conductive terminals that are arranged in two spaced-apart rows. The rows have differential signal terminal pairs separated from each other by larger intervening ground shields that serve as ground terminals. The ground shields are arranged in alternating fashion within each row of terminals and they are closely spaced together so as to define within the rows of each connector unit, a horizontal serpentine pattern of ground shields that cooperate to act as a single "pseudo" shield within each pair of terminal rows.

19 Claims, 37 Drawing Sheets

U.S. PATENT DOCUMENTS

| | | | | |
|---|---|---|---|---|
| 7,163,421 | B1 | 1/2007 | Cohen et al. | |
| 7,195,497 | B2 | 3/2007 | Hull et al. | |
| 7,267,515 | B2 | 9/2007 | Lappöhn | |
| 7,322,856 | B2 * | 1/2008 | Laurx et al. | 439/607.1 |
| 7,338,321 | B2 | 3/2008 | Laurx | |
| 7,384,311 | B2 | 6/2008 | Sharf et al. | |
| 7,458,839 | B2 | 12/2008 | Ngo et al. | |
| 7,473,138 | B2 | 1/2009 | Tuin et al. | |
| 7,553,190 | B2 | 6/2009 | Laurx et al. | |
| 7,591,655 | B2 | 9/2009 | Fedder et al. | |
| 2001/0010979 | A1 | 8/2001 | Ortega et al. | |
| 2003/0171010 | A1 | 9/2003 | Winings et al. | |
| 2004/0043648 | A1 | 3/2004 | Houtz | |
| 2004/0097112 | A1 | 5/2004 | Minich et al. | |
| 2006/0172570 | A1 | 8/2006 | Minich | |
| 2007/0021001 | A1 | 1/2007 | Laurx et al. | |
| 2007/0021003 | A1 | 1/2007 | Laurx et al. | |
| 2007/0021004 | A1 | 1/2007 | Laurx et al. | |
| 2007/0049118 | A1 * | 3/2007 | Reeser et al. | 439/608 |
| 2007/0059952 | A1 | 3/2007 | Raistrick et al. | |
| 2009/0011642 | A1 | 1/2009 | Amleshi et al. | |
| 2009/0011643 | A1 | 1/2009 | Amleshi et al. | |
| 2009/0011644 | A1 | 1/2009 | Amleshi et al. | |
| 2009/0011655 | A1 | 1/2009 | Amleshi et al. | |
| 2009/0011664 | A1 | 1/2009 | Laurx et al. | |
| 2009/0017681 | A1 | 1/2009 | Amleshi et al. | |
| 2009/0017682 | A1 * | 1/2009 | Amleshi et al. | 439/608 |

FOREIGN PATENT DOCUMENTS

| | | | |
|---|---|---|---|
| EP | 1 732 176 | A1 | 12/2006 |
| WO | WO 86/01644 | | 3/1986 |
| WO | WO 01/57964 | | 8/2001 |
| WO | WO 2007/058756 | | 5/2007 |
| WO | WO 2007/076900 | | 7/2007 |
| WO | WO 2008/002376 | A2 | 1/2008 |
| WO | WO 2008/156856 | | 12/2008 |

* cited by examiner

| E[v/M] |
| --- |
| 8.0000e+003-K |
| 7.2000e+003-J |
| 1.6000e-004-J |
| 6.4000e+003-I |
| 5.6000e+003-H |
| 4.8000e+003-G |
| 4.0000e+003-F |
| 3.2000e+003-E |
| 2.4000e+003-D |
| 1.6000e+000-C |
| 8.0000e+002-B |
| 0.0000e+000-A |

FIG.11A

Cross Talk Pin Map Example

| | 1 | 2 | 3 | 4 | 5 | 6 | 7 | 8 | 9 | 10 |
|---|---|---|---|---|---|---|---|---|---|---|
| A | G | S | G | S | G | S | G | S | G | S |
| B | S | S | S | S | S | S | S | S | S | S |
| C | S | G | S | G | S | G | S | G | S | G |
| D | G | S | G | S | G | S | G | S | G | S |
| E | S | S | S | S | S | S | S | S | S | S |
| F | S | G | S | G | S | G | S | G | S | G |
| G | G | S | G | S | G | S | G | S | G | S |
| H | S | S | S | S | S | S | S | S | S% | S |
| J | S | G | S | G | S | G | S | G | S% | G |
| K | G | S | G | S | G | S | G | S% | G | S* |
| L | S | S | S | S | S | S | S | S% | S | S* |
| M | S | G | S | G | S | G | S | G | S | G |
| N | G | S | G | S | G | S | G | S* | G | S% |
| O | S | S | S | S | S | S | S | S* | S% | S% |
| P | S | G | S | G | S | G | S | G | S% | G |

G Ground

S S Victim

S% S% Aggressor Measured

S* S* Aggressor

Worst Case Crosstalk for Victim Pair L9M9

| | $T_{rise}$ = 33ps (20-80%) | |
|---|---|---|
| | %NEXT | %FEXT |
| Aggressors | | |
| H9J9 | 0.38 | 0.28 |
| O9P9 | 0.33 | 0.45 |
| K8L8 | 0.40 | 0.20 |
| N10O10 | 0.68 | 0.23 |
| N8O8 | 0.68 | 0.23 |
| K10L10 | 0.40 | 0.20 |
| Total | %2.87 | %1.59 |

FIG.29
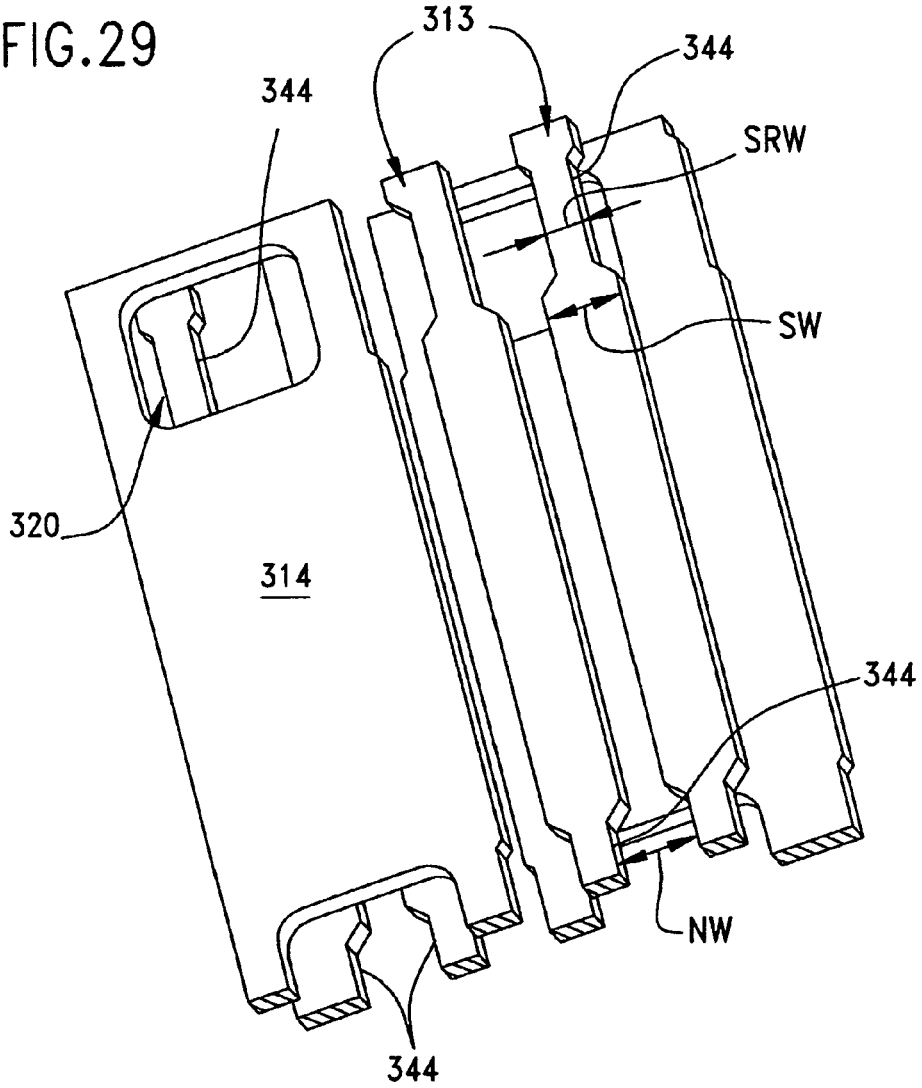
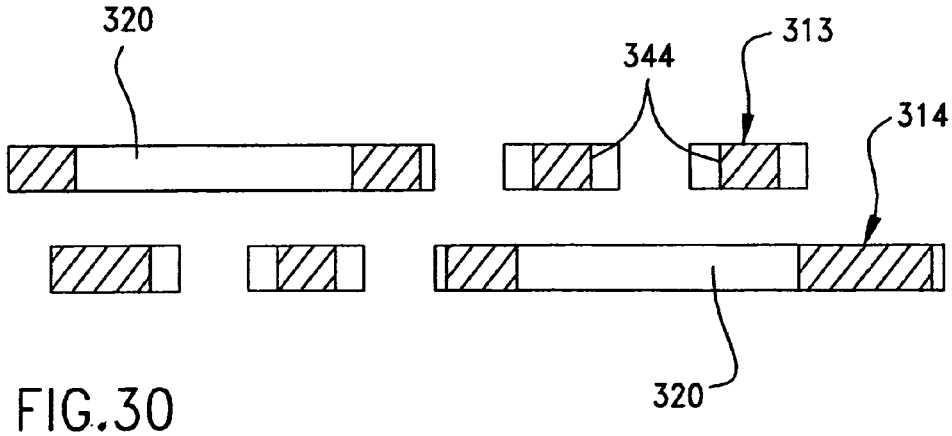
FIG.30

MEZZANINE-STYLE CONNECTOR WITH SERPENTINE GROUND STRUCTURE

REFERENCE TO RELATED APPLICATIONS

This application claims the domestic benefit of U.S. Provisional Application Nos. 60/936,383 and 60/936,384, both filed on Jun. 20, 2007, the disclosures of which are herein incorporated by reference.

BACKGROUND OF THE INVENTION

The present invention relates generally to high speed connectors, and more particularly to high speed backplane connectors, of the mezzanine-style with reduced crosstalk and improved performance.

High speed connectors are used in many data transmission applications particularly in the telecommunications industry. Signal integrity is an important concern in the area of high speed and data transmission for components need to reliably transmit data signals. The high speed data transmission market has also been driving toward reduced size components and increased signal density.

High speed data transmission is utilized in telecommunications to transmit data received from a data storage reservoir or a component transmitter and such transmission most commonly occurs in routers and servers. As the trend of the industry drives toward reduced size, the signal terminals in high speed connectors must be reduced in size and to accomplish any significant reduction in size, the terminals of the connectors must be spaced closer together. As signal terminal are positioned closer together, signal interference occurs between the closely spaced signal terminals, and especially between pairs of adjacent differential signal terminals. This is referred to in the art as "crosstalk" and it occurs when the electrical fields of signal terminals abut each other and intermix. At high speeds the signal of one differential signal pair may drift and cross over to an adjacent or nearby differential signal pair. This affects signal integrity of the entire signal transmission system. The reduction of crosstalk in high speed data systems is a key goal in the design of high speed connectors.

Previously, reduction of crosstalk was accomplished primarily by the use of inner shields positioned between adjacent sets of differential signal terminals. These shields were relatively large metal plates that act as an electrical field barrier, between rows or columns of differential signal terminals. These shields add significant cost to the connector and also increase the size of the connector. The shields may also increase the capacitive coupling of the signal terminals to ground and thereby lower the impedance of the connector system. If the impedance is lowered because of the inner shields, care must be taken to ensure that it does not exceed, or fall, below a desired value at that specific location in the connector system. The use of shields to reduce crosstalk in a connector system requires the system designer to take into account the effect on impedance and the effect on the size of the connector of these inner shields.

Some have tried to eliminate the use of shields and rely upon individual ground terminals that are identical in shape and dimension to that of the differential signal terminals with which they are associated. The use of ground terminals similarly sized to that of the signal terminals requires careful consideration to spacing of all the terminals of the connector system throughout the length of the terminals. In the mating interface of high speed connector, impedance and crosstalk may be controlled due to the large amounts of metal that both sets of contacts present. It becomes difficult to match the impedance within the body of the connector and along the body portions of the terminals in that the terminal body portions have different configurations and spacing than do the contact portions of the terminals. The body portions and the contact (mating) and termination (mounting) portions of connectors require careful design and high-speed engineering to provide properly matched impedances. Each section presents different challenges. Connector body portions, especially the terminals therein must typically be controlled for changes in terminal geometry and dielectric performance. Mating sections (contacts) must be controlled for typically increased size and portion.

The present invention is therefore directed to a high speed connector for mezzanine-style applications and which overcomes the above-mentioned disadvantages and which uses a plurality individual shields for each differential signal pair to control crosstalk, and in which the individual shields cooperatively act as a single shield along the terminal body portions of the connector.

SUMMARY OF THE INVENTION

It is therefore a general object of the present invention to provide an improved connector for high speed data transmission which has reduced crosstalk and which does not require large metal shields interposed between groups of signal terminals.

Another object of the present invention is to provide a high speed connector for backplane applications in which a plurality of discrete pair of differential signal terminals are arranged in pairs within columns of terminals, each differential signal pair being flanked by an associated ground shielded terminal in an adjacent column, the ground shield terminal having dimensions greater than that of one of the differential signal terminals so as to provide a large reference ground in close proximity to the differential signal pair so as to permit the differential signal pair to broadside couple to the individual ground shield facing it.

A further object of the present invention is to provide a high speed backplane connector that utilizes a plurality of differential signal terminal pairs to effect data transmission, wherein its differential signal terminal pairs are arranged in a "triad" configuration in association with an enlarged ground terminal, and the terminals are arranged in two adjacent columns within a single connector unit, the enlarged ground terminals acting as individual ground shields, the ground shields in one column being spaced apart from and aligned with a differential signal terminal pair in the other column of the connector unit, the ground shields being staggered in their arrangement within the two columns and being closed spaced together such that they cooperatively act as a single, or "psuedo" ground shield in each connector unit.

Yet a further object of the present invention is to provide a connector of the type described above where the ground shields in each pair of columns within each connector unit trace a serpentine path through the body portion of the connector unit from the top of the connector unit to the bottom thereof to provide enhanced isolation from crosstalk.

A still further object of the present invention is to provide a high speed connector that utilizes a series of terminal assemblies supported within connector wafers, each connector wafer supporting a pair of columns of conductive terminals, the terminals being arranged in pairs of differential signal terminals within the column and flanked by larger ground shield terminals in the body of the connector, the ground shields being alternatively arranged in the column so that each differential signal pair in one column has a ground shield facing it in the other column and a ground shield adjacent to it within the column so that the two differential signal terminals are edge coupled to each other within the column and are broadside coupled to a ground shield in an adjacent column.

Yet a still further object of the present invention is to provide a high speed connector for use in backplane applications with reduced crosstalk, the connector including a backplane header and a daughter card connector, the daughter card connector being formed from a plurality of discrete units, each such unit including an insulative frame formed from two halves, the insulative frame supporting a plurality of conductive terminals, one column by each frame so that an assembled unit supports a pair of terminal columns within the support frame, the terminals being arranged in each column in an arrangement, or pattern, such that differential signal terminals are arranged edge to edge in pairs within each single column, each edge to edge differential signal terminal pair being supported within its column in a spacing from another such signal terminal pair by an intervening ground shield terminal having a greater surface area than that of the edge to edge differential signal terminal pair, the ground shields of each column within a connector unit facing a differential signal terminal pair of its neighboring columns, the ground shield terminals being spaced closely together so as to define one large pseudo-shield that extends through the frame in a serpentine pattern in the pair of columns.

A yet still further object of the present invention is to provide a connector of the "mezzanine"-style, for connecting two spaced-apart circuit boards together, the connector including a receptacle portion for mounting to one of the two circuit boards and a plug portion for mounting to the other of the two circuit boards, the plug member including a plurality of separate connector elements, each of the connector elements including an insulative frame that supports a plurality of conductive terminals in a linear array, the terminals being arranged within the each array in a preferred signal-signal-ground arrangement, wherein the ground terminals are wider than the signal terminals, and each pair of signal terminals is flanked, on at least one end, by a wider ground terminal.

Another further object of the present invention is to provide a high speed connector that utilizes a series of terminal arrays supported within connector elements, the terminals being arranged in linear arrays and each array containing pairs of differential signal terminals, the pairs of signal terminal being flanked by larger ground shields, in the form of wide terminals in the body of each connector element, the ground shields being alternatingly arranged in the array and juxtaposed within adjacent arrays so that each differential signal pair in any array has at least two ground shield associated therewith, one of the ground shields in an adjacent array faces the pair of signal terminals from a side thereof, and the other ground shield facing an end of the signal pair within the array, the terminals in adjacent arrays being spaced apart so as provide an air interface therebetween.

An additional object of the present invention is to provide two connector elements for use in the aforesaid connectors, one of the elements having raised portions on their housings that extend between the signal terminals in its supported terminal array and within the ground terminals of its supported terminal array and the housings of the other connector elements including raised ribs, or bars, that extend crosswise with respect to the terminal arrays, the raised ribs meeting and abutting the raised portions so as to provide an air spacing between terminals of adjacent arrays.

The present invention accomplishes these and other objects by virtue of its unique structure. In one principal aspect, the present invention encompasses a backplane connector that utilizes a header connector intended for mounting on a backplane and a right angle connector intended for mounting on a daughter card. When the two connectors are joined together, the backplane and the daughter card are joined together, typically at a right angle.

The right angle connector, which also may be referred to as a daughter card connector, is formed from a series of like connector units. Each connector unit has an insulative frame formed, typically molded from a plastic or other dielectric material. This frame supports a plurality of individual connector units, each supporting an array of conductive terminals. Each connector unit frame has at least two distinct and adjacent sides, one of which supports terminal tail portions and the other of which supports the terminal contact portions of the terminal array. Within the body of the daughter card connector, the frame supports the terminals in a columnar arrangement, or array so that each unit supports a pair of terminal columns therein.

Within each column, the terminals are arranged so as to present isolated differential signal pairs. In each column, the differential signal terminal pairs are arranged edge to edge in order to promote edge (differential mode) coupling between the differential signal terminal pairs. The larger ground shield terminals are firstly located in an adjacent column directly opposite the differential signal terminal pair and are secondly located in the column adjacent (above and below) the differential signal terminal pairs. In this manner, the terminals of each differential signal terminal pair within a column edge couple with each other but also engage in broadside coupling to the ground shield terminals in adjacent columns facing that differential signal terminal pairs. Some edge coupling occurs between the terminals of the differential signal pairs and the adjacent ground shield terminals. The larger ground shield terminals, in the connector body, may be considered as arranged in a series of inverted V-shapes, which are formed by interconnecting groups of three ground shield terminals by imaginary lines and a differential signal terminal pair is nested within each of these V-shapes. In this manner, the terminals of each differential signal pair are isolated from coupling electrical noise into other differential signal pairs and isolated from having other differential signal pairs couple electrical noise into them. The in-column ground shields located above and below a given differential signal pair form a barrier in a vertical manner and the adjacent column ground shields form a horizontal barrier to electrical noise.

The frame is an open frame that acts as a skeleton, or network, that holds the columns of terminals in their preferred alignment and spacing. In this regard, the frame includes at least intersecting vertical and horizontal parts and at least one bisector that extends out from the intersection to divide the area between the vertical and horizontal members into two parts. Two other radial spokes subdivide these parts again so that form district open areas appear on the outer surface of each of the connector unit wafer halves. This network of radial spokes, along with the base vertical and horizontal members, supports a series of ribs that provide a mechanical backing for the larger ground shield terminals. The spokes are also preferably arranged so that they serve as a means for transferring the press-in load that occurs on the top of the daughter card connector to the compliant pin tail portions during assembly of the daughter card connector to the daughter card.

The radial spokes are continued on the interior surface of one of the connector unit wafer halves and serves as standoffs to separate the columns of terminals when the two connector unit wafer halves are married together so that an air spacing is present between the columns of terminals. The signal and larger ground shield terminals make at least two bends in their extent through the connector body and in these bend areas, the impedance of the connector units is controlled by reducing the amount of metal present in both the differential signal terminal pair and in their associated ground shield terminals. This reduction is accomplished in the ground shield terminals by forming a large window and in the signal terminal by "necking" or narrowing the signal terminal body portions down in order to increase the distance between the signal terminal edges.

This modification is also implemented present in other areas within the connector unit, where the wafer halves are joined together. The connector unit wafer halves are joined together in the preferred embodiment by posts formed on one wafer half that engage holes formed on the other wafer half. The above-mentioned windows are formed in the large ground shield terminals, in line with the support spokes of the support frame, and the posts project through these openings. The necked down portions of the differential signal terminal pairs are also aligned with the support spokes of the connector unit support frame and the ground shield terminal windows. In this manner, broadside coupling of the differential signal terminal is diminished with the ground shield terminals at this area.

A transition is provided where the terminal tail portions meet the terminal body portions, so as to create a uniform mounting field of the terminal tail portions. In this regard, the tail ends of terminal body portions extend outwardly from their location adjoining the centerline of the connector unit, and toward the sides of the connector units so as to achieve a desired, increased width between the terminal tail portions of the two columns so that the tail portions are at a certain pitch, widthwise between columns. In order to achieve a desired depth between the terminal tail portions within each column, the ends of the terminal body portion near the terminal tail portions shift in the lateral direction along the bottom of the connector unit support frame, so that the tail portions are arranged in a uniform spacing, rather than in an uneven spacing were the tail portions to be centered with the ends of the terminal body portions.

The present invention may be implemented in a mezzanine-style connector arrangement where the connector is used to join together two parallel, and facing, circuit boards. In such an application, one portion of the connector serves as a receptacle member, while the portion of the connector serves as a plug member that is received within the receptacle member. The receptacle member includes an insulative housing with a plurality of conductive terminals, or pins, while the plug member includes a plurality of individual terminal arrays that are supported by respective individual wafers, or supports. The plug member terminals bifurcated contact elements at one end that provide a redundant contact with each corresponding pin of the receptacle member, and at the other end thereof, tail portions that are arranged to maintain a given grid spacing for the connector.

The wafers of the mezzanine-style connector are formed from two parts and are formed so as to provide air spacings between the terminals of the two parts. The ground terminals of the connector are formed wider that the signal terminal and the ground terminals have windows, or opening formed therein that assist in their mounting to the wafer parts as well as controlling the impedance of the overall connector. In one wafer part, the ground terminal opening admit plastic, or housing material therethrough during the molding process, as well as through necks that are formed in the edges of the signal and ground terminal to hold that wafer's part terminals in place. In the other mating wafer part, the housing material extends through the openings and necks and is formed as a rib or bar that extends transversely across the terminals to form a surface, or shoulder, that abuts the opposing terminals in the area of their openings and necks. Additionally, portions of the housings are formed so as to provide insulative columns adjacently behind the ground terminals.

These and other objects, features and advantages of the present invention will be clearly understood through a consideration of the following detailed description.

BRIEF DESCRIPTION OF THE DRAWINGS

In the course of this detailed description, reference will be frequently made to the attached drawings in which:

FIG. 11A is a crosstalk pin map of the connector of FIG. 1, identifying the rows and columns of terminals by alpha and numerical designations, respectively and identifying actual crosstalk obtained from testing of a connector of the present invention;

FIG. 29 is an enlarged detail view, taken through the body of the connector, of two rows of terminals of connectors of the invention, illustrating the overlapping nature of the ground terminal window with respect to a facing pair of signal terminals; and, FIG. 30 is a sectional view taken through some of the terminals of FIG. 29, illustrating the positions between the signal terminal pair and the ground terminal.

DETAILED DESCRIPTION OF THE PREFERRED EMBODIMENTS

Figure 1:
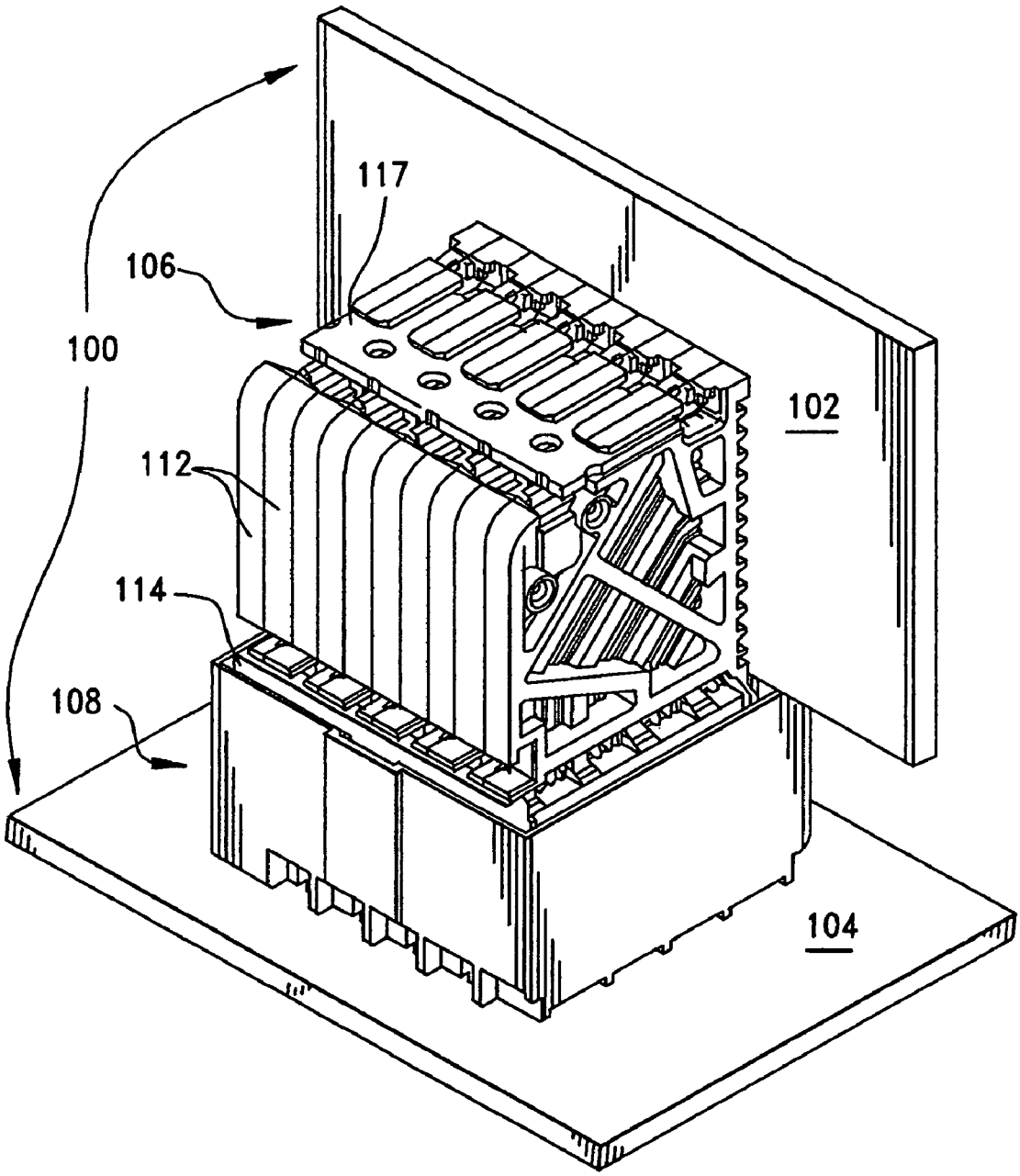
FIG. 1 is a perspective view of a backplane connector assembly constructed in accordance with the principles of the present invention in which a daughter card connector mates with a pin header to interconnect two circuit boards together.
Figure 2:
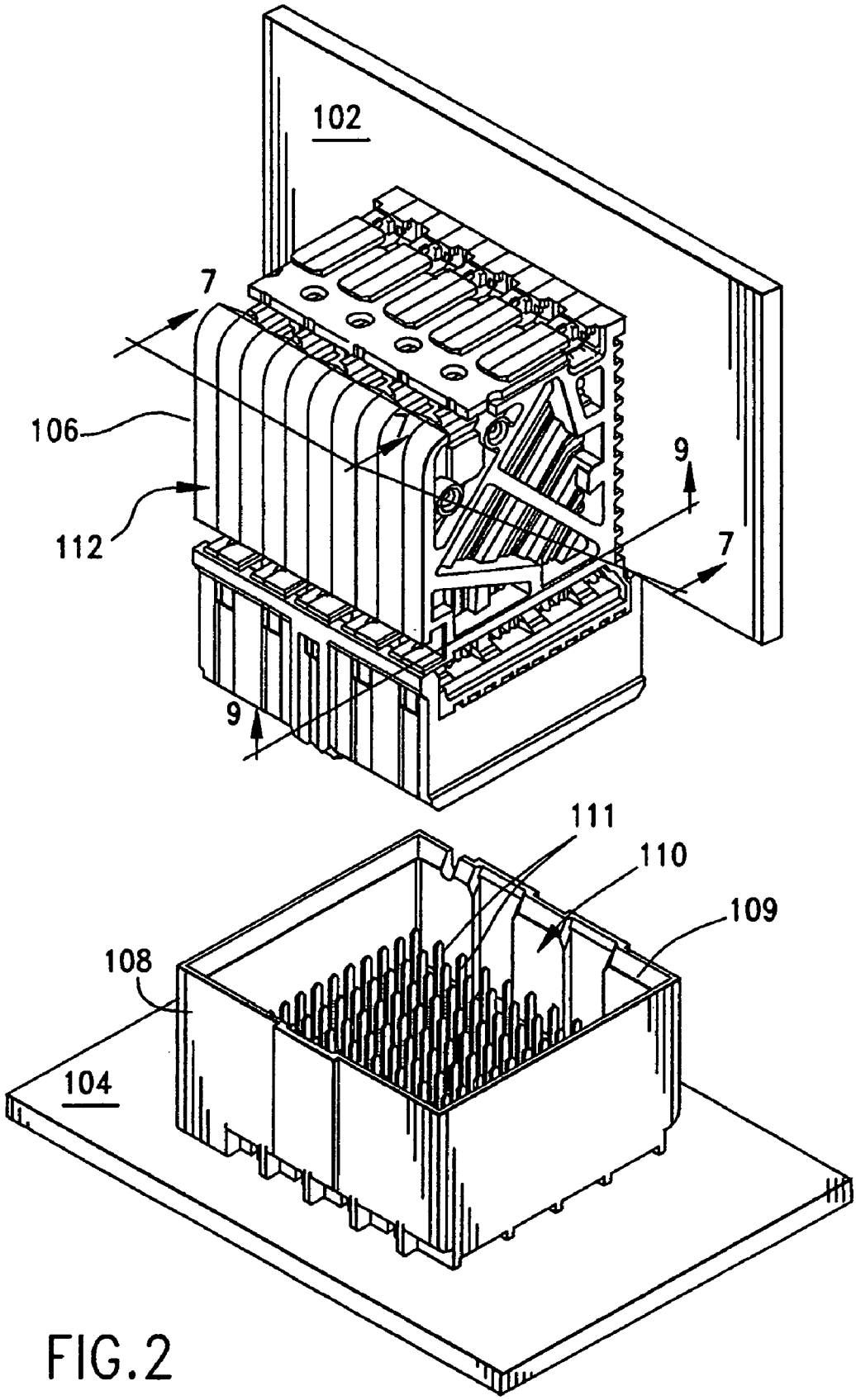
FIG. 2 is the same view as FIG. 1, but illustrating the daughter card connector removed from the backplane pin header.

FIG. 1 illustrates a backplane connector assembly 100 that is constructed in accordance with the principles of the present invention and which is used to join an auxiliary circuit board 102, known in the art as a daughter card, to another circuit board 104, typically referred to in the art as a backplane. The assembly 100 includes two connectors 106 and 108. As shown best in FIG. 2, the backplane connector 108 takes the form of a pin header having four sidewalls 109 that cooperatively define a hollow receptacle 110. A plurality of conductive terminals in the form of pins 111 are provided and held in corresponding terminal-receiving cavities of the connector 108 (not shown). The pins 111 are terminated, such as by tail portions, to conductive traces on the backplane 104 and these tail portions fit into plated vias, or throughholes, disposed in the backplane 104.

Figure 3:
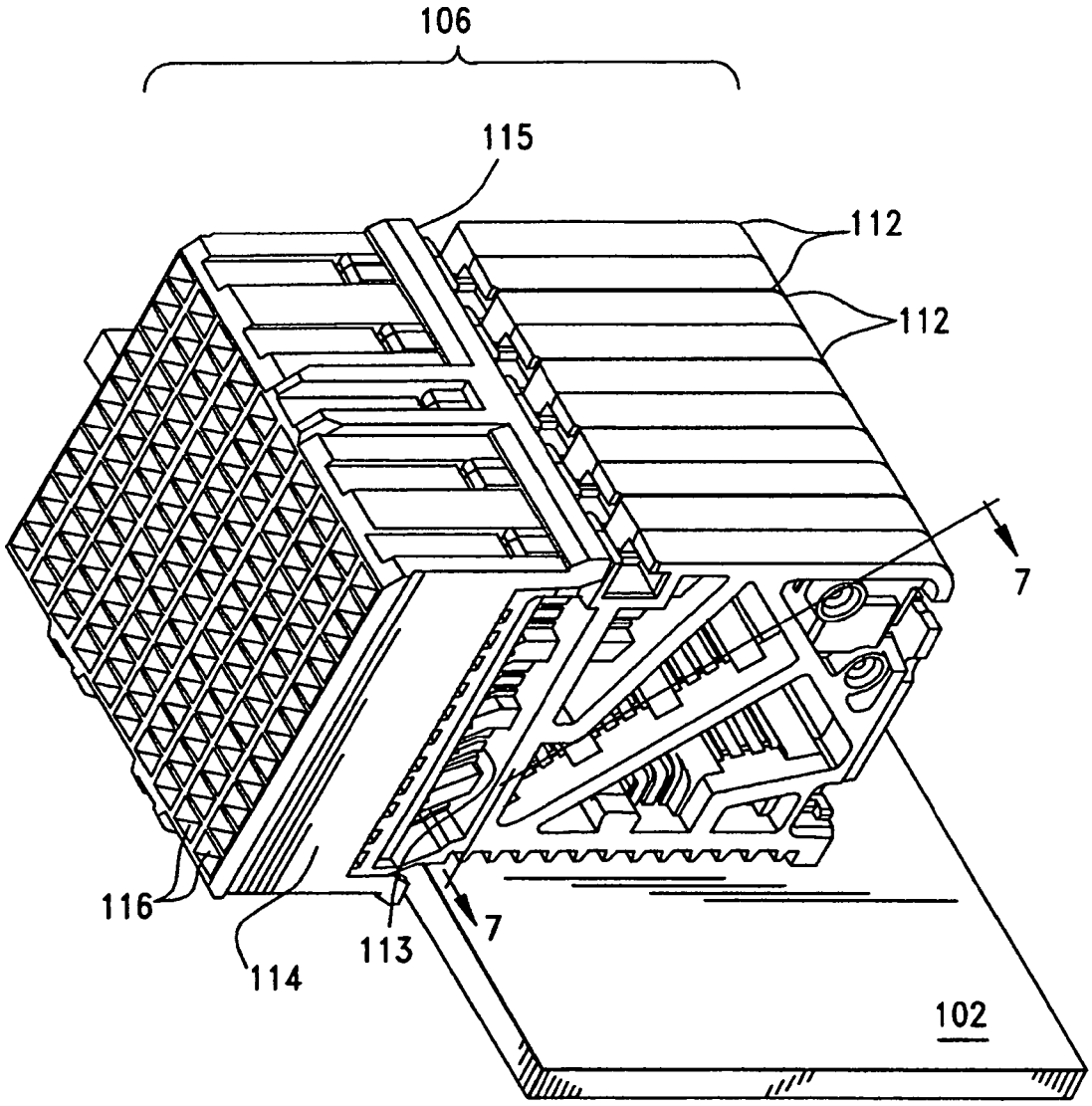
FIG. 3 is a perspective view of the daughter card connector of FIG. 2, at a different angle thereof, illustrating it with a front cover, or shroud, applied to the individual connector units.

Turning to FIG. 3, the daughter card connector 106 is composed of a plurality of individual and discrete connector units 112 that house conductive terminals 113 with tail portions 113*a* and contact portions 113*b* (FIG. 4) disposed at opposite ends of the terminals. The terminal contact portions 113*b* are joined to the terminal tail portions 113*a* by intervening body portions 113*c*. These body portions 113*c*, extend, for the most part through the body portion of the connector unit, from approximately the base frame member 131 to the additional vertical frame member 135. The connector units 112 have their front ends 115 inserted into a hollow receptacle formed within a front cover, or shroud, 114. (FIG. 3.) The shroud 114 has a plurality of openings 116 which are aligned with the pins 111 of the backplane connector 108 (as well as the terminal contact portions 113*b*), so that when the daughter card connector 106 is inserted into the backplane connector 108, the pins are engaged by the contact portions 113*b* of the terminals 113 of the daughter card connector 106. The connector units 112 may be further held together with a stiffener, or brace 117, that is applied to the rear surfaces 118 of the connector units 112.

Figure 5A:
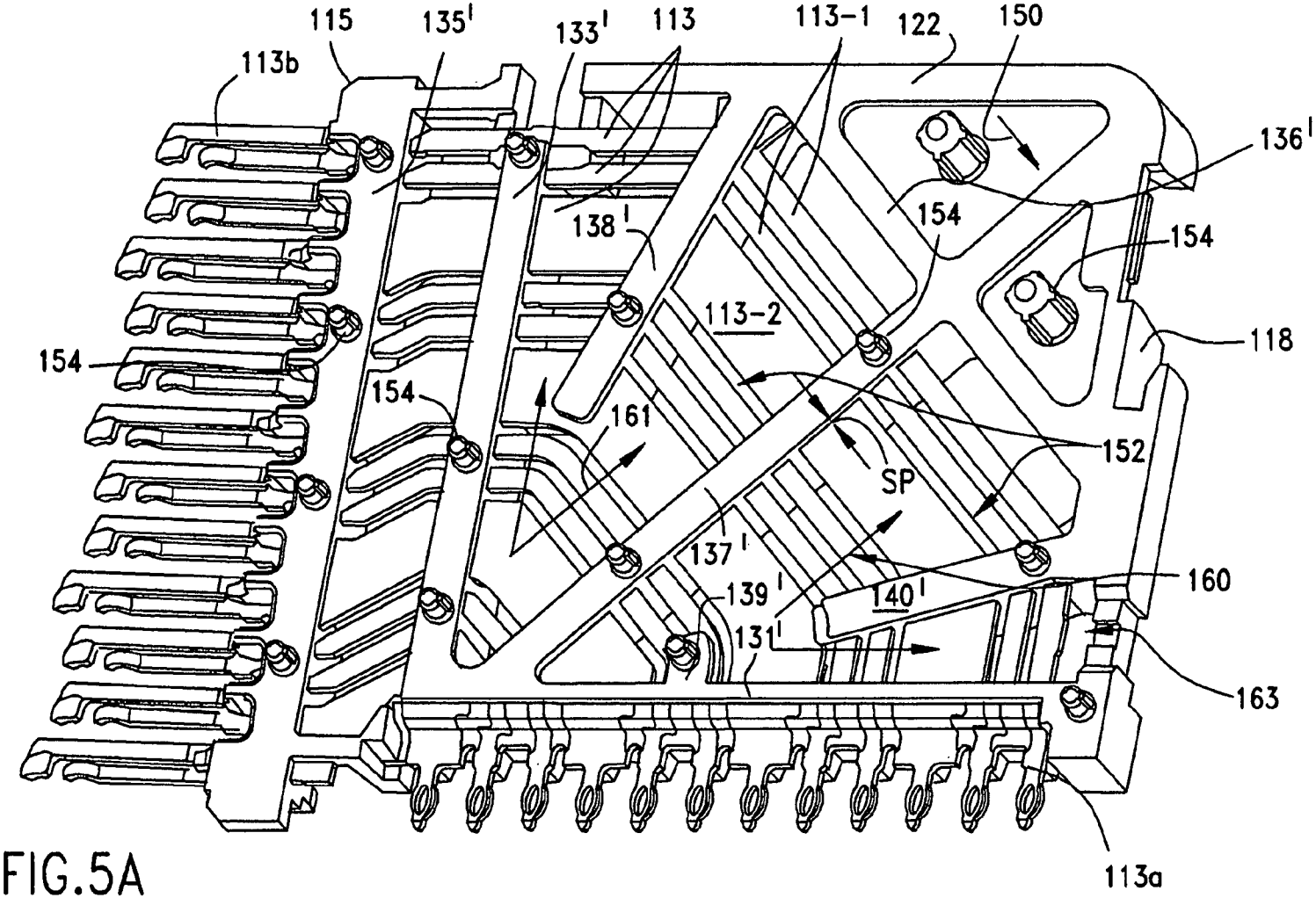
FIG. 5A is an interior view of the right hand wafer half of the connector unit of FIG. 4.
Figure 8A:
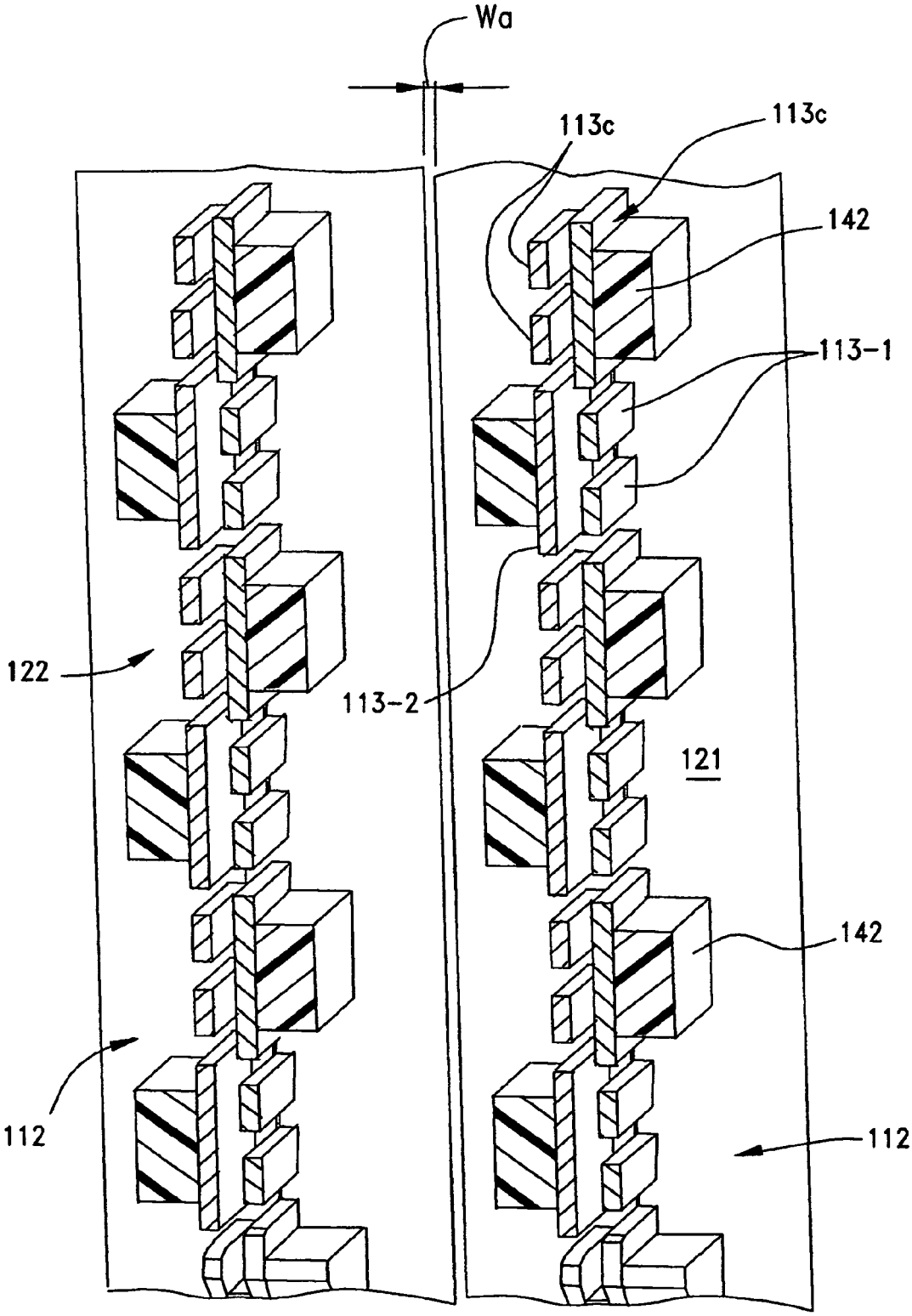
FIG. 8A is a slight perspective view of the sectioned face of the daughter card connector of FIG. 7, illustrating two adjacent connector units, or wafers.
Figure 8B:
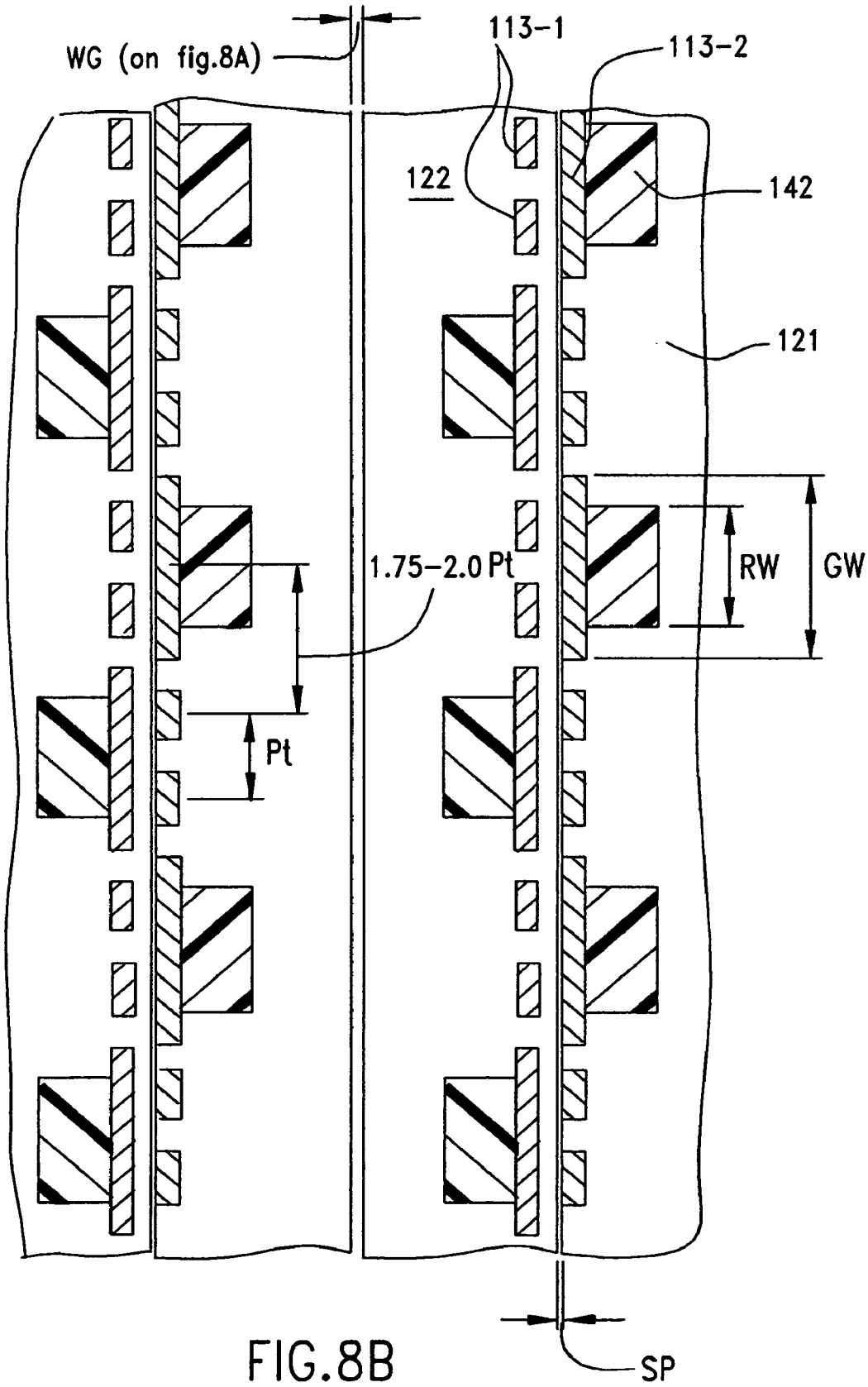
FIG. 8B is a front elevational view of FIG. 8A.

Each connector unit 112, in the preferred embodiment of the invention, takes the form of a wafer that is formed by the wedding, or marriage, of two waflets or halves 121, 122 together. The right hand wafer half 122 is illustrated open in FIG. 5A, while the left hand wafer halve 121 is shown open in FIG. 5B. Each wafer half 121, 122 holds an array of conductive terminals 113 in a particular pattern. The array of terminals defines a "column" of terminals in the wafer half when viewed from the mating end, i.e., the end of the wafer half that supports the terminal contact portions 113*b*. Thus, when two of the wafer halves (right and left wafer halves) are mated together each wafer, or connector unit 112, supports a pair of columns of terminals 113 that are spaced apart widthwise within the connector unit 112. This spacing is shown in FIG. 8B as "SP" and is provided by the interior spokes 133', 135', 137', 139, 139' and 140' of the connector units 112 as best shown in FIG. 5A. For reliability, the contact portions 113*b* of the terminals 113 are provided with pairs of contact arms as shown in the drawings. This bifurcated aspect ensures that the daughtercard connector terminals will contact the backplane connector pins even if the terminals are slightly misaligned.

Figure 7:
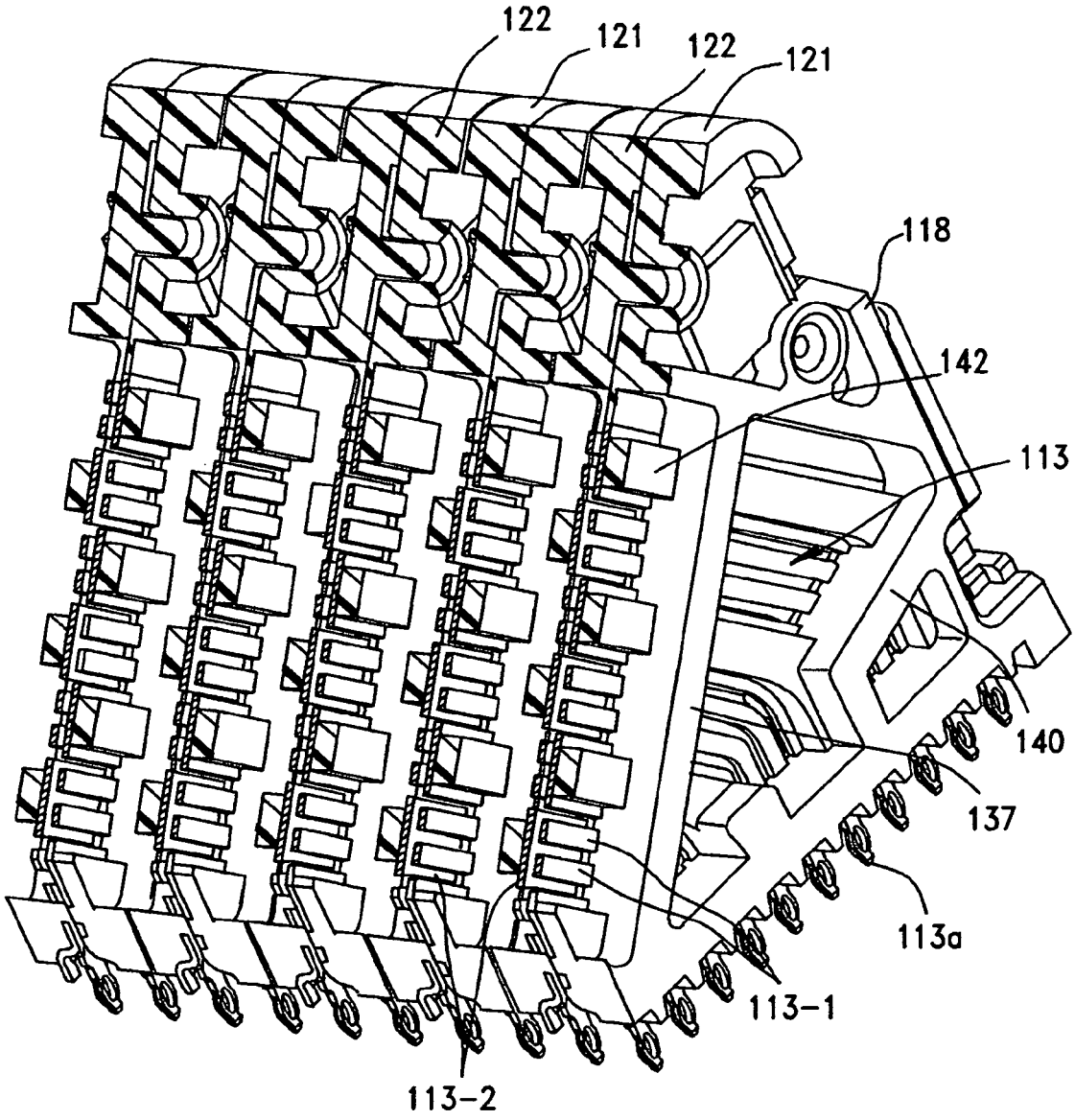
FIG. 7 is a sectional view of the daughter card connector of FIG. 2 or 3, taken along lines 7-7 thereof to expose the terminal body portions and to generally illustrate the "triad" nature of the differential signal pairs utilized in each connector unit.
Figure 7A:
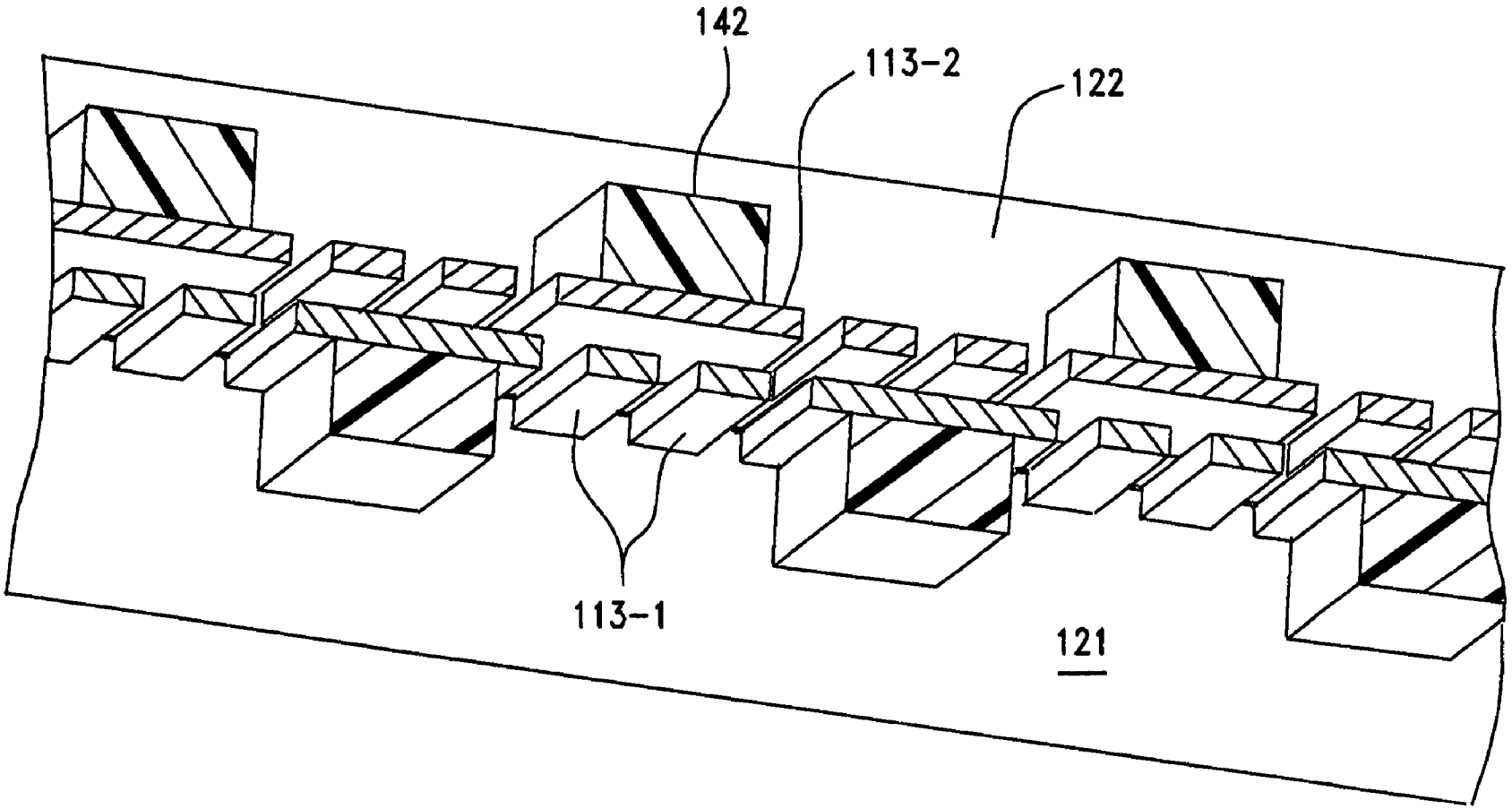
FIG. 7A is an enlarged, detailed view of one wafer of the sectioned daughter card connector of FIG. 7, specifically illustrating the "triad" nature of the terminal body portions of the daughter card connector unit.
Figure 7B:
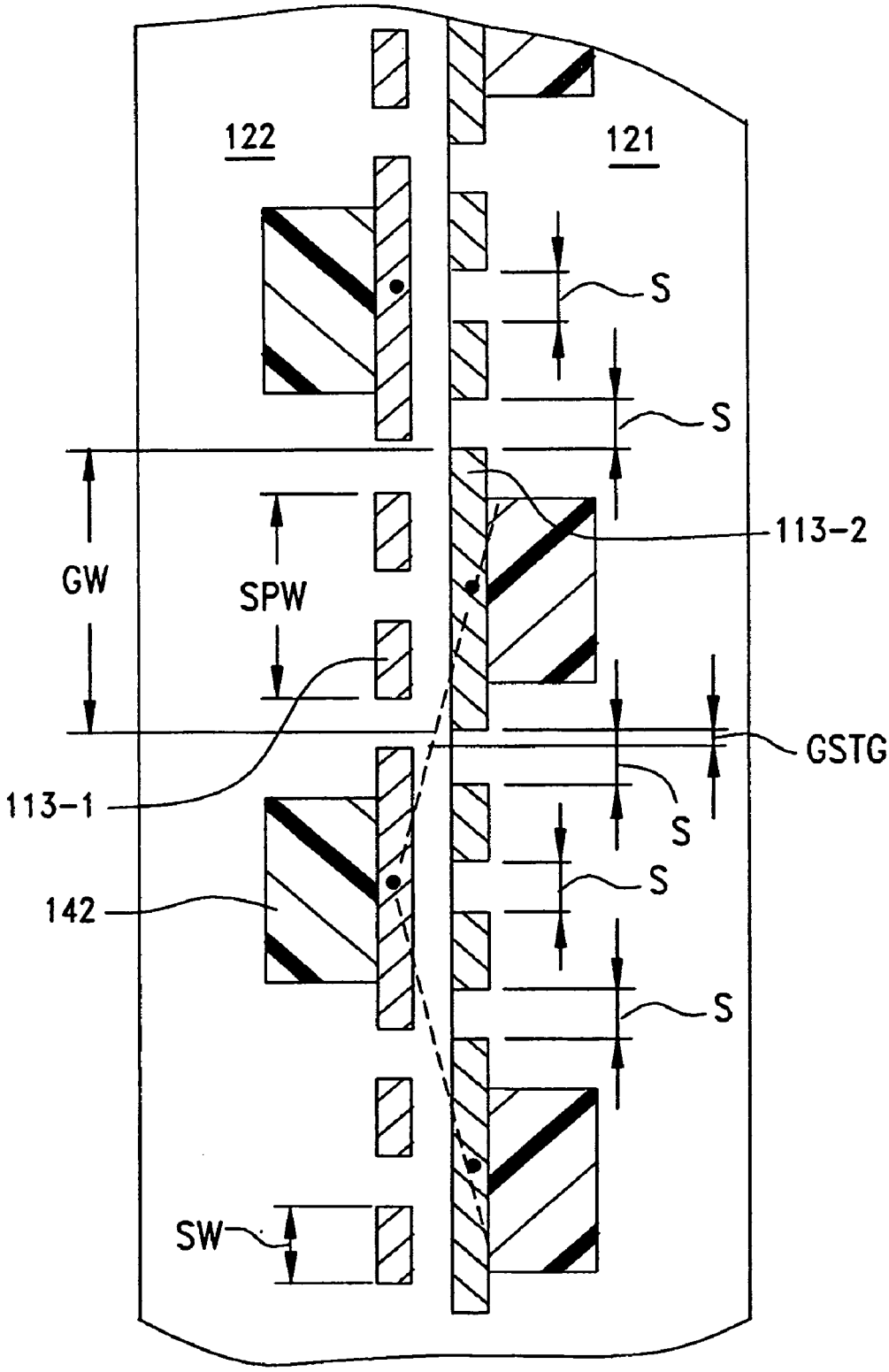
FIG. 7B is a front elevational view of the detailed view of FIG. 7A.

In one principal aspect of the present invention, the terminals 113 are separated into distinct signal terminals 113-1 and ground shield terminals 113-2. The ground shield terminals 113-2 are used to mechanically separate the signal terminals into signal terminal pairs across which differential signals will be carried when the connectors of the invention are energized and operated. The ground shield terminals 113-2 are larger in size than each individual signal terminal 113-1 and are also larger in surface area and overall dimensions than a pair of the signal terminals 113-1 and as such, each such ground shield terminal 113-2 may be considered as an individual ground shield disposed within the body of the connector unit 112. The dimensions and arrangement of the signal and ground shield terminals are best shown in FIG. 7B, where it can be seen that within each wafer half, the ground shield terminals 113-2 are separated from each other by intervening spaces. These spaces contain a pair of signal terminals 113-1, which are aligned with the ground shield terminals 113-2 so that all of the terminals 113 are arranged substantially in a single line within the column of terminals.

These signal terminals 113-1 are intended to carry differential signals, meaning electrical signals of the same absolute value, but different polarities. In order to reduce cross-talk in a differential signal application, it is wise to force or drive the differential signal terminals in a pair to couple with each other or a ground(s), rather than a signal terminal or pair of terminals in another differential signal pair. In other words, it is desirable to "isolate" a pair of differential signal terminals to reduce crosstalk at high speeds. This is accomplished, in part, by having the ground shield terminals 113-2 in each terminal array in the wafer halves offset from each other so that each pair of signal terminals 113-1 opposes, or flanks, a larger ground terminal 113-2. By "larger" is meant both in surface area and in terminal width. FIG. 7B illustrates this arrangement best. Due to the larger size of the ground shield terminal 113-2, it primarily acts as an individual ground shield for each differential signal pair that it faces within a wafer (or connector unit). The differential signal pair of terminals couple in a broadside manner, to this ground shield terminal 113-2. The terminal columns of the two connector unit halves 121, 122 are separated by a small spacing, shown as SP in FIGS. 8A and 8B, so that for most of their extent through the connector unit, the terminals in one column of the connector unit are separated from the terminals in the other column of the connector unit by air, which has a dielectric constant of 1. The ground shield terminal 113-2 also further acts, secondarily, as a ground shield to the terminals of each differential signal pair 113-1 that lie above and below it in the column of terminals (FIG. 7B). The nearest terminals of these differential signal terminal pairs edge couple to the ground shield terminal 113-2. The two terminal columns are also closely spaced together and are separated by the thickness of the interior spokes, and this thickness is about 0.25 to 0.35 mm, which is a significant reduction in size compared to other known backplane connectors.

Such a closely-spaced structure promotes three types of coupling within each differential signal channel in the body of the daughter card connector: (a) edge coupling within the pair, where the differential signal terminals of the pair couple with each other; (b) edge coupling of the differential signal terminals to the nearest ground shield terminals in the column of the same wafer half; and, (c) broadside coupling between the differential signal pair terminals and the ground shield terminal in the facing wafer half. This provides a localized ground return path that may be considered, on an individual signal channel scale, as shown diagrammatically in FIG. 7B, as having an overall V-shape when imaginary lines are drawn through the centers of the ground shield terminal facing the differential signal pair into intersection with the adjacent ground shield terminal that lie on the edges of the differential signal pair. With this structure, the present invention presents to each differential signal terminal pair, a combination of broadside and edge coupling and constrains the differential signal terminal pair into better differential mode coupling within the signal pair.

On a larger, overall scale, within the body of the connector, these individual ground shield terminals further cooperatively define a serpentine pseudo-ground shield within the pair of columns in each wafer. By use of the term "pseudo" is meant that although the ground shield terminals 113-2 are not mechanically connected together, they are closely spaced together both widthwise and edgewise, so as to electrically act as if there were one continuous shield present in the wafer, or connector unit. This extends throughout substantially the entire wafer where the ground shield terminal 113-2 is larger than the signal terminals 113-1, namely from the bottom face to the vertical support face. The opposing edges of the ground shield terminals may be aligned with each other along a common datum line or as shown in FIG. 7B, there may be a gap GSTG disposed between the edges of the adjacent grounds, and this gap has a distance that is preferably 7% or less of the width GW of the ground shield terminal.

The ground shield terminal 113-1 should be larger than its associated differential signal pair by at least about 15% to 40%, and preferably about 34-35%. For example, a pair of differential signal terminals may have a width of 0.5 mm and be separated by a spacing of 0.3 mm for a combined width, SPW, of 1.3 mm, while the ground shield terminal 113-2 associated with the signal pair may have a width of 1.75 mm. The ground shield terminals 113-2 in each column are separated from their adjacent signal terminals 113-1 by a spacing S, that is preferably equal to the spacing between signal terminals 113-1, or in other words, all of the terminals within each column of each wafer half are spaced apart from each other by a uniform spacing S.

Figure 10A:
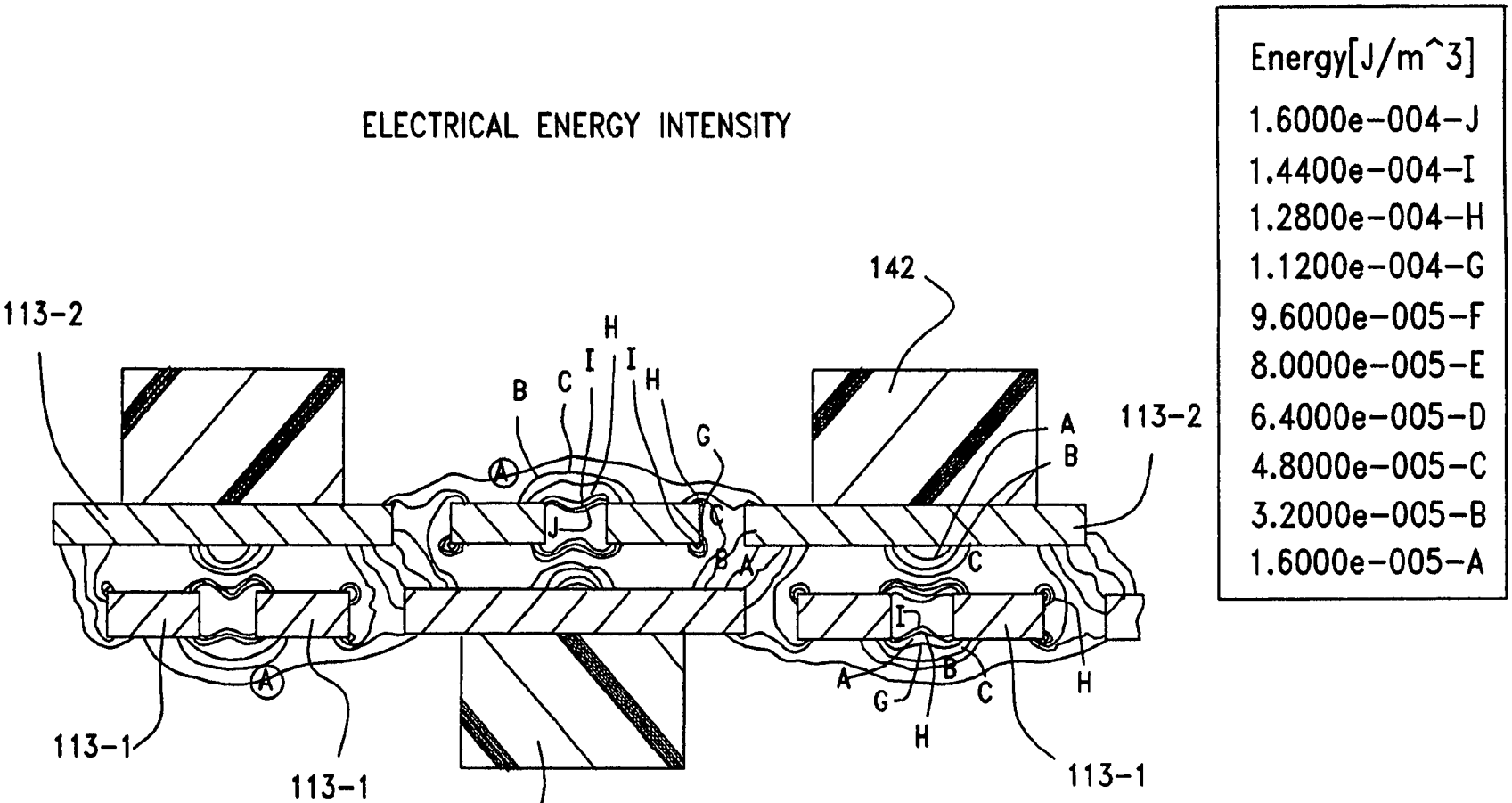
FIG. 10A is an electrical field intensity plot of the terminal body portions of two differential signal channels within the daughter card connector of FIG. 2.
Figure 10B:
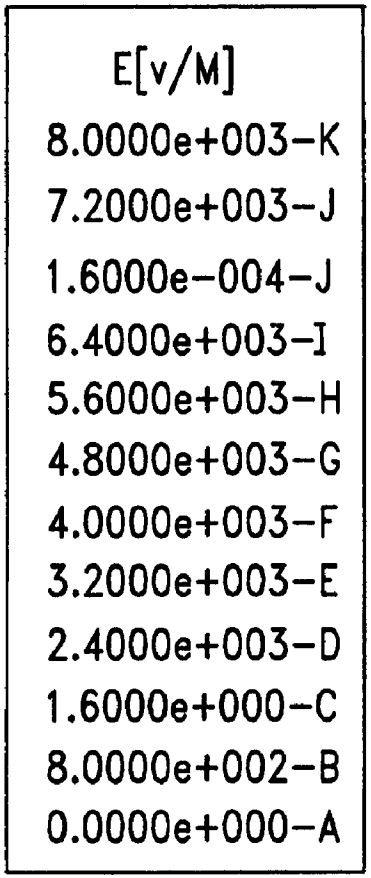
FIG. 10B is an electrical field intensity plot of the body portions of a group of six connector units of the daughtercard connector of FIG. 2.
Figure 10B:
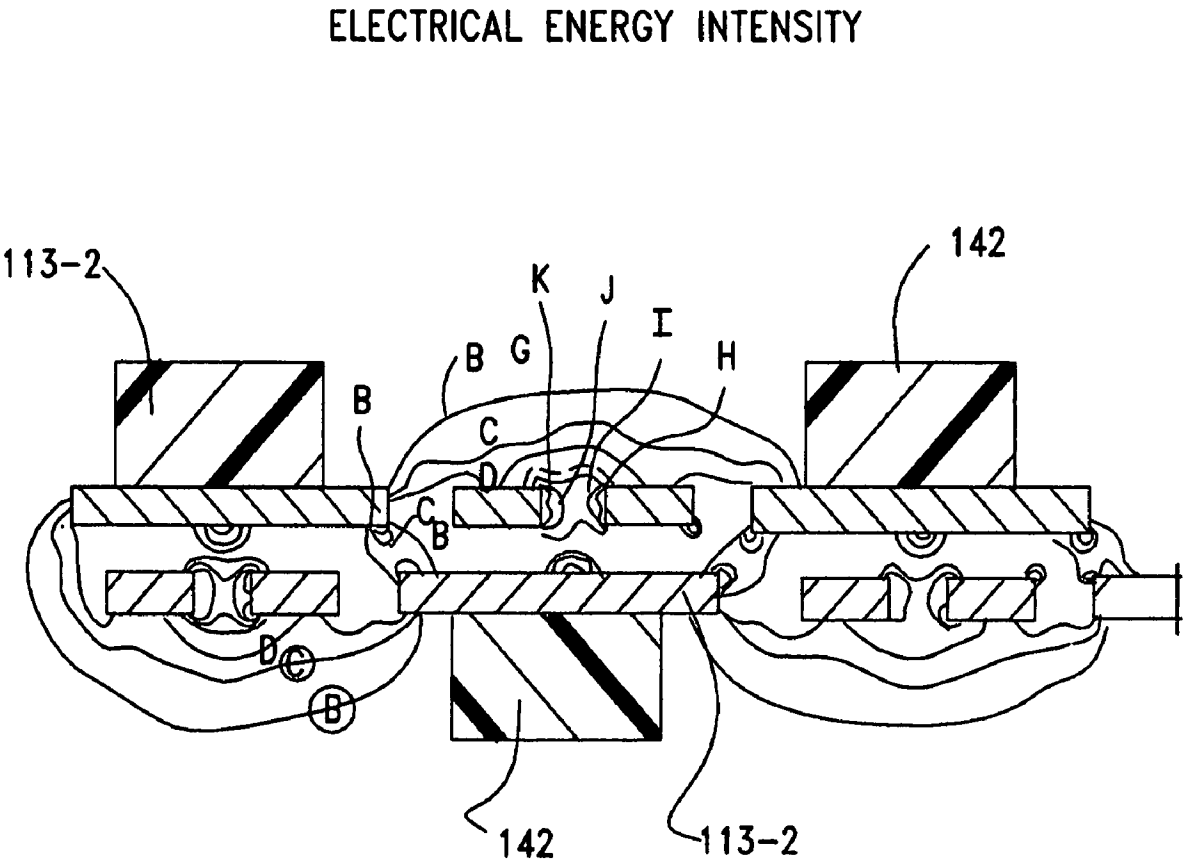

The larger ground shield terminals serve to provide a means for constraining the differential signal terminal pair into differential mode coupling, which in the present invention is edge coupling in the pair, and maintaining it in that mode while reducing any differential mode coupling with any other signal terminals to an absolute minimum. "Larger" as used herein means greater in both dimensional size and surface area. This relationship is best shown in FIGS. 10A and 10B which are respectively, electrical energy intensity and electrical field intensity plots of the terminal body portions. FIG. 10A is an electrical energy intensity plot of the triad-type structure described above. The plots were obtained through modeling a section of the body of the connector unit of the present invention in the arrangement illustrated in FIG. 7B with four differential signal terminal pairs 113-1 and four opposing ground shield terminals 113-2, using ANSOFT HFSS software, in which a differential voltage was assigned to the two signal terminals 113-1 of the pair and the electrical field and energy intensities generated.

These models demonstrate the extent of coupling that will occur in the connectors of the invention. The magnitude of the energy field intensity that occurs between the edges of the two terminals in each differential signal pair, as shown in FIG. 10A, ranges from 1.6 to $1.44\times10^{-4}$ Joule/meter$^3$, while the magnitude of the energy intensity between the two angled edges of the signal terminal pairs between the columns diminishes down to $1.6\times10^{-5}$ and approaches zero, demonstrating the isolation that can be obtained with the present invention. Similarly FIG. 10B expresses the electrical field intensity in volts/meter and it shows the field intensity between the edges of the coupled differential signal terminal pair as ranging from $8.00\times10^3$ while the field intensity reduces down to 2.40 to 0.00 volts/meter on the angled path that interconnects the edges of two adjacent differential signal terminal pairs.

Figure 11B:
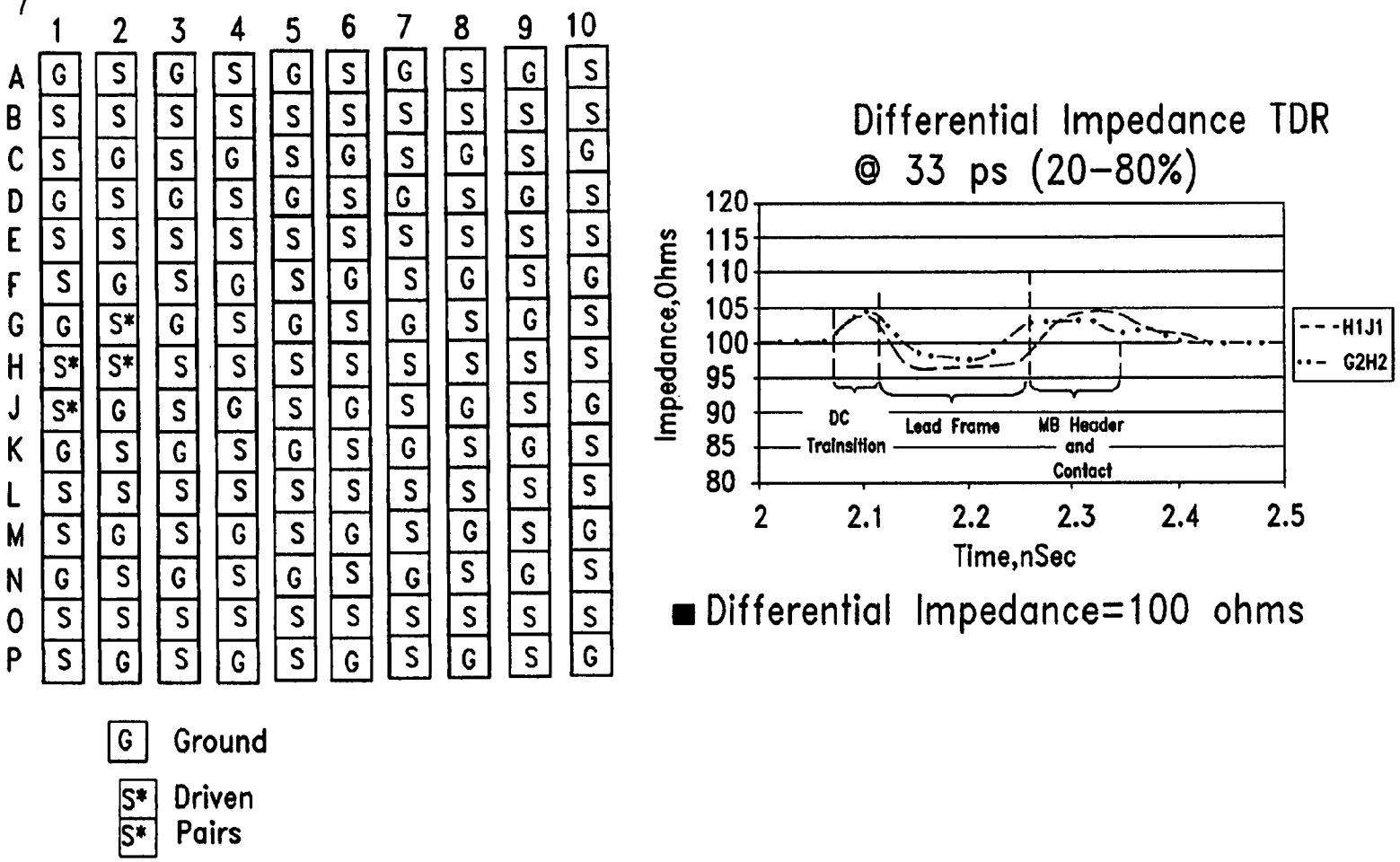
FIG. 11B is a differential impedance plot of a pair of differential signal terminals chosen from the pin map of FIG. 11A identifying the impedance obtained from a simulation of a connector of the present invention.
Figure 11C:
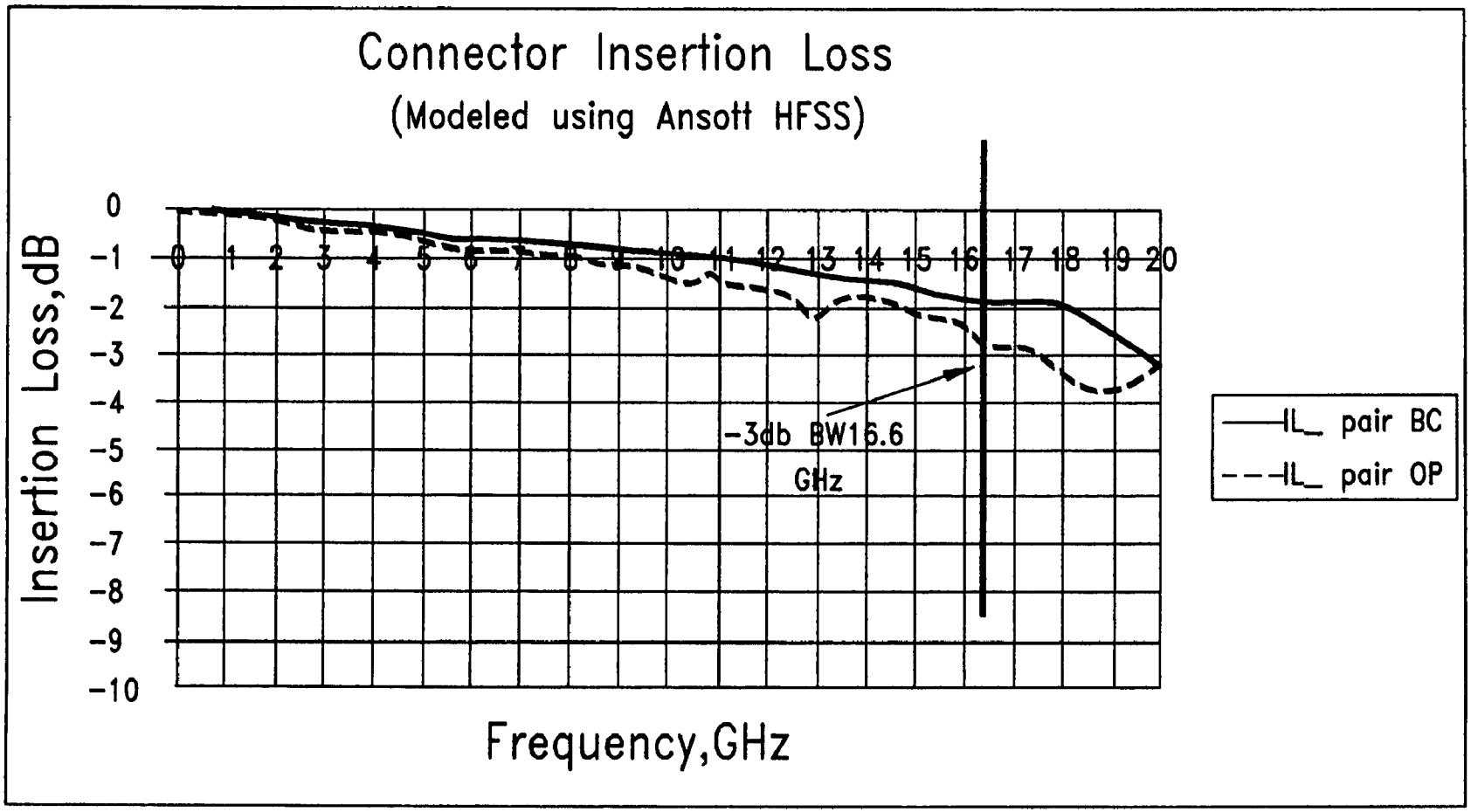
FIG. 11C is a connector insertion loss plot obtained through modeling the connectors of the invention illustrating the minimum and maximum losses incurred and a −3 db loss at a frequency of 16.6 GhZ.
Figure 11D:
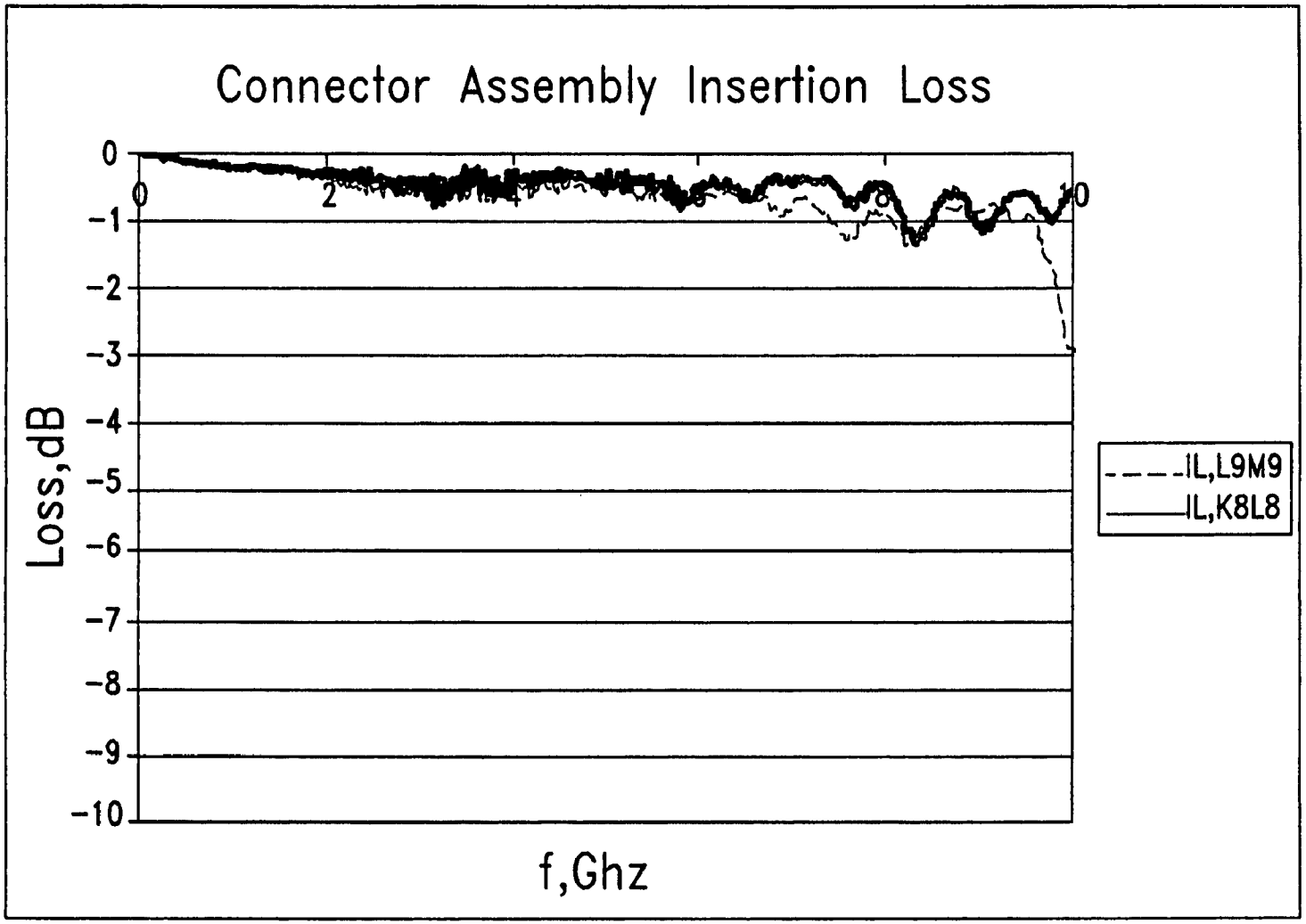
FIG. 11D is a connector assembly insertion loss plot which illustrates the results of actual testing of the connector assembly of FIG. 1 in place in two circuit boards, illustrating an insertion loss of −3 db at a speed of about 10 GHz.

FIGS. 11*c* and 11D illustrate the modeled and measured insertion loss of connectors of the invention. FIG. 11C is an insertion loss plot of the connector as shown in FIG. 1, less the two circuit boards and it shows the maximum and minimum loss values obtained using ANSOFT HFSS from the differential signal pairs in rows BC and OP (corresponding to the pin map of FIG. 11A). It indicates that the connector should have a loss of −3 db at a frequency of about 16.6 Ghz, which is equivalent to a data transfer rate of 33.2 Gigabits/second. FIG. 11D is an insertion loss plot obtained through testing of an early embodiment of the connector of FIG. 1, including its circuit boards. Again, the maximum and minimum losses are plotted for differential signal pairs at L9M9 and K8L8 and the insertion loss is −3 db at about 10 Ghz frequency, which is capable of supporting a data transfer rate of about 20 Gigabits/second or greater.

Figure 12:
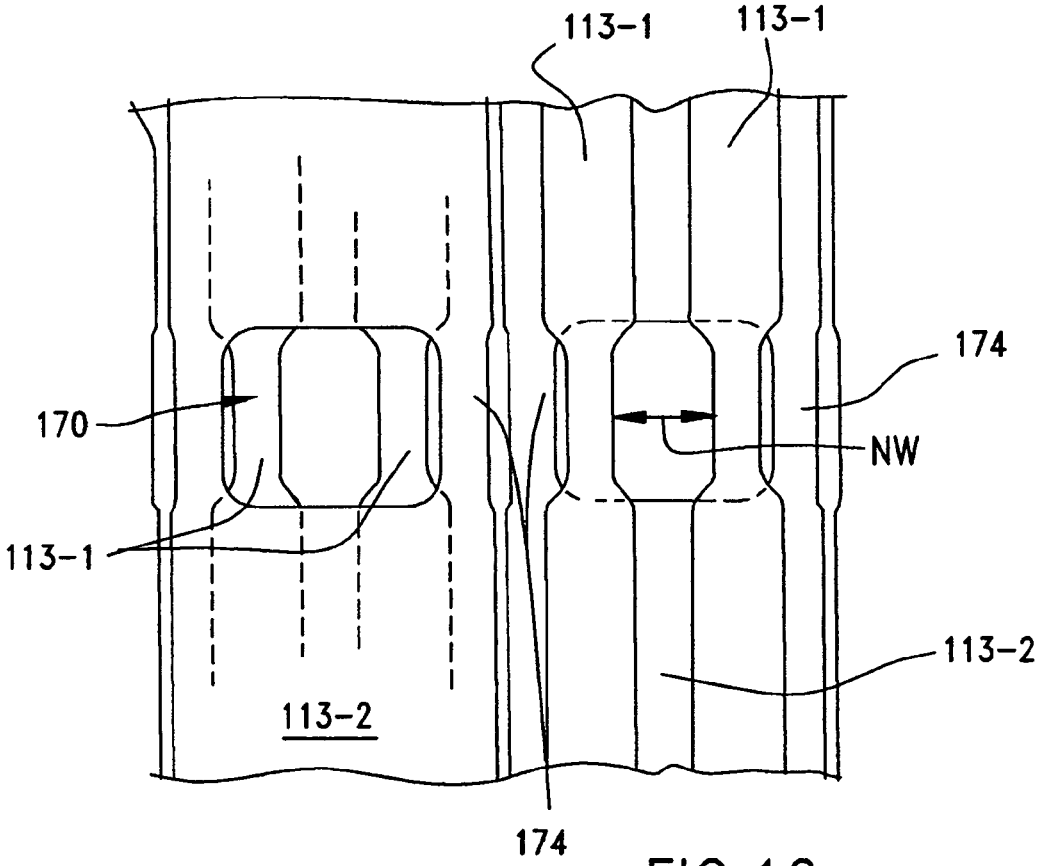
FIG. 12 is an enlarged detail view of the area where the terminal array of the connector crosses a support frame spoke of the connector unit.

FIG. 11A is a crosstalk pin map representing the pin layout of a connector constructed in accordance with the principles of the present invention and as shown in FIG. 1. In order to identify the relevant terminals of the connector, the rows of terminal have an alphabetical designation extending along the left edge of the map, while the columns are designated numerically along the top edge of the map. In this manner, any pin may be identified by a given letter and number. For example, "D5", refers to the terminal that is in the "D" row of the "5" column. A victim differential signal pair was tested by running signals through four adjacent differential signal pairs that are designated in FIG. 12 as "aggressor" pairs. Two of the six surrounding adjacent pairs are identical or mirror images of their counterparts so that only four of the six aggressor pairs were tested, as is common in the art. The testing was done with a mated daughtercard and backplane connector mounted in place on circuit boards, at a rise time of 33 picoseconds (20-80%) which is equivalent to a data transfer rate of approximately 10 gigabits per second through the terminals. As can be seen in the table below, the cumulative near end crosstalk (NEXT) on the victim pair was 2.87% and the far end crosstalk (FEXT) was 1.59%, both values being below 3%, and FIG. 11B is a plot of the differential impedance (TDR) modeled through the connector using signals at a 33 picosecond (ps) rise time (20-80%) taken along the differential signal terminal pairs, H1-J1 and G2-H2 of FIG. 11A.

The impedance achieved is approximately +/−10% of the desired baseline 100 ohm impedance through the connector assembly and circuit boards at a 33 picosecond rise time. The various segments of the connector assembly are designated on the plot. The impedance rises only about 5 ohms (to about 103-104 ohms) in the transition area of the daughter card connector 106 where the terminal tail portions expand to define the terminal body portions, and the impedance of the pair terminal body portions, where the larger ground shield terminals 113-2 are associated with their differential signal terminal pairs drops about 6-8 ohms (to about 96-97 ohms) and remains substantially constant through the connector unit support frame. As the daughter card connector terminal contact portions 113*b* make contact with the terminals 111 of the backplane connector 108, the impedance rises about 6-8 ohms (to about 103-104 ohms), and then the impedance through the backplane connector (pin header) 108 reduces down toward the baseline 100 ohm impedance value. Thus, it will be appreciated that connectors of the invention will have low cross-talk while maintaining impedance in an acceptable range of +/−10%.

Returning to FIG. 4, each wafer half has an insulative support frame 130 that supports its column of conductive terminals. The frame 130 has a base part 131 with one or more standoffs 132, in the form of posts or lugs, which make contact with the surface of the daughter card where the daughter card connector is mounted thereto. It also has a vertical front part 133 formed therewith. These parts may be best described herein as "spokes" of the frame 130, and the front spoke 133 and the base spoke 131 mate together to define two adjacent and offset surfaces of the connector unit and also substantially define the boundaries of the body portions 113*c* of the terminals 113. That is to say, the body portions 113*c* of the terminals 113, in the area where the ground shield terminals 113-2 are wider and larger than their associated differential signal terminal pair, extend between the base and front spokes 131, 133.

The bottom spoke 131 and the front spoke 133 are joined together at their ends at a point "O" which is located at the forward bottom edge of the connector units 112. From this junction, a radial spoke 137 extends away and upwardly as shown in a manner to bisect the area between the base and vertical spoke 135 into two parts, which, if desired, may be two equal parts or two unequal parts. This radial spoke 137 extends to a location past the outermost terminals in the connector unit 112. Additional spokes are shown at 138, 139 & 140. Two of these spokes, 138 and 139 are partly radial in their extent because they terminate at locations before the junction point "O" and then extend in a different direction to join to either the vertical front spoke 135 or the base spoke 131. If their longitudinal centerlines would extend, it could be seen that these two radial spokes emanate from the junction point "O". Each terminus of these two part-radial spokes 138, 140 occurs at the intersection with a ground shield rib 142, the structure and purpose of which is explained to follow. The radial spokes are also preferably arranged in a manner, as shown in FIG. 4, to evenly transfer the load imposed on the connector units to the top parts of the compliant pin terminal tail portions when the connector units are pressed into place upon the daughter card 102.

The ribs 142 of the support frame provide the ground shield terminals with support, but they also serve as runners in the mold to convey injected plastic or any other material from which the connector unit support frames are formed. These ribs 142 are obviously open areas in the support frame mold and serve to feed injected melt to the spokes and to the points of attachment of the terminals to the support frame. The ribs 142 preferably have a width RW as best shown in FIG. 8B, that is less than the ground shield terminal width GW. It is desired to have the width of the rib 142 less than that of the ground shield terminals 113-2 so as to effect coupling between the edge of a differential signal terminal pair facing the edge of the ground shield terminal 113-2 and its rib 142 so as to limit the concentration of an electrical field at the ground terminal edges, although it has been found that the edges of the rib 142 can be made coincident with the edges of the ground shield terminals 113-2. However, keeping the edges of the ribs 142 back form the edges of the ground shield terminals 113-2 facilitates molding of the connector units for it eliminates the possibility of mold flash forming along the edges of the ground shield terminal and affecting the electrical performance thereof. The ground shield terminal also provides a datum surface against which mold tooling can abut during the molding of the support frames. As shown in FIG. 8A and as utilized in one commercial embodiment of the present invention, the backing ribs 142 have a width that ranges from about 60 to about 75% of the width of the ground shield terminal 113-2, and preferably have a width of about 65% that of the ground shield terminal.

Figure 4:
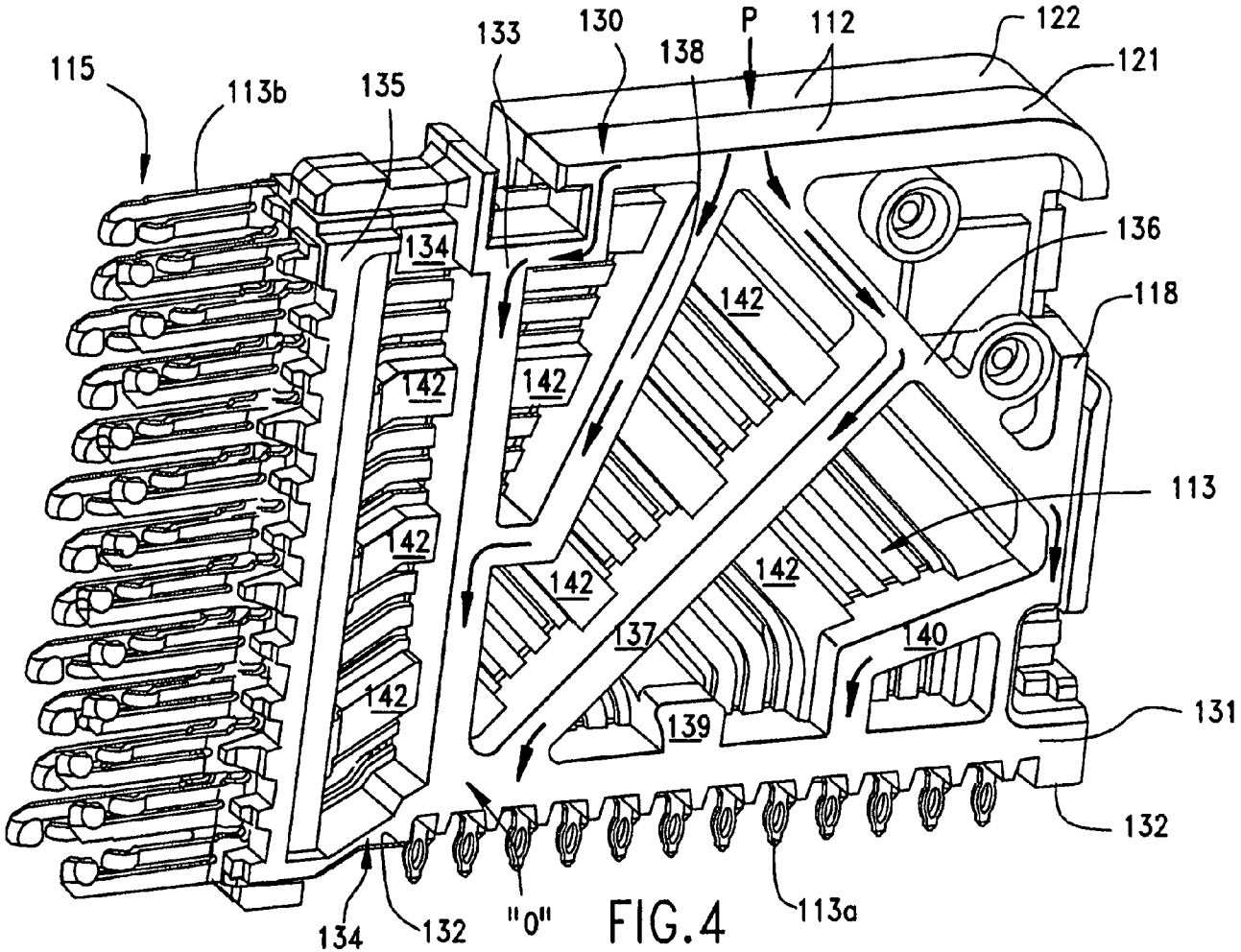
FIG. 4 is a slight perspective view of one connector unit that is used in the connector of FIG. 3, and shown in the form of a wafer assembly.
Figure 6:
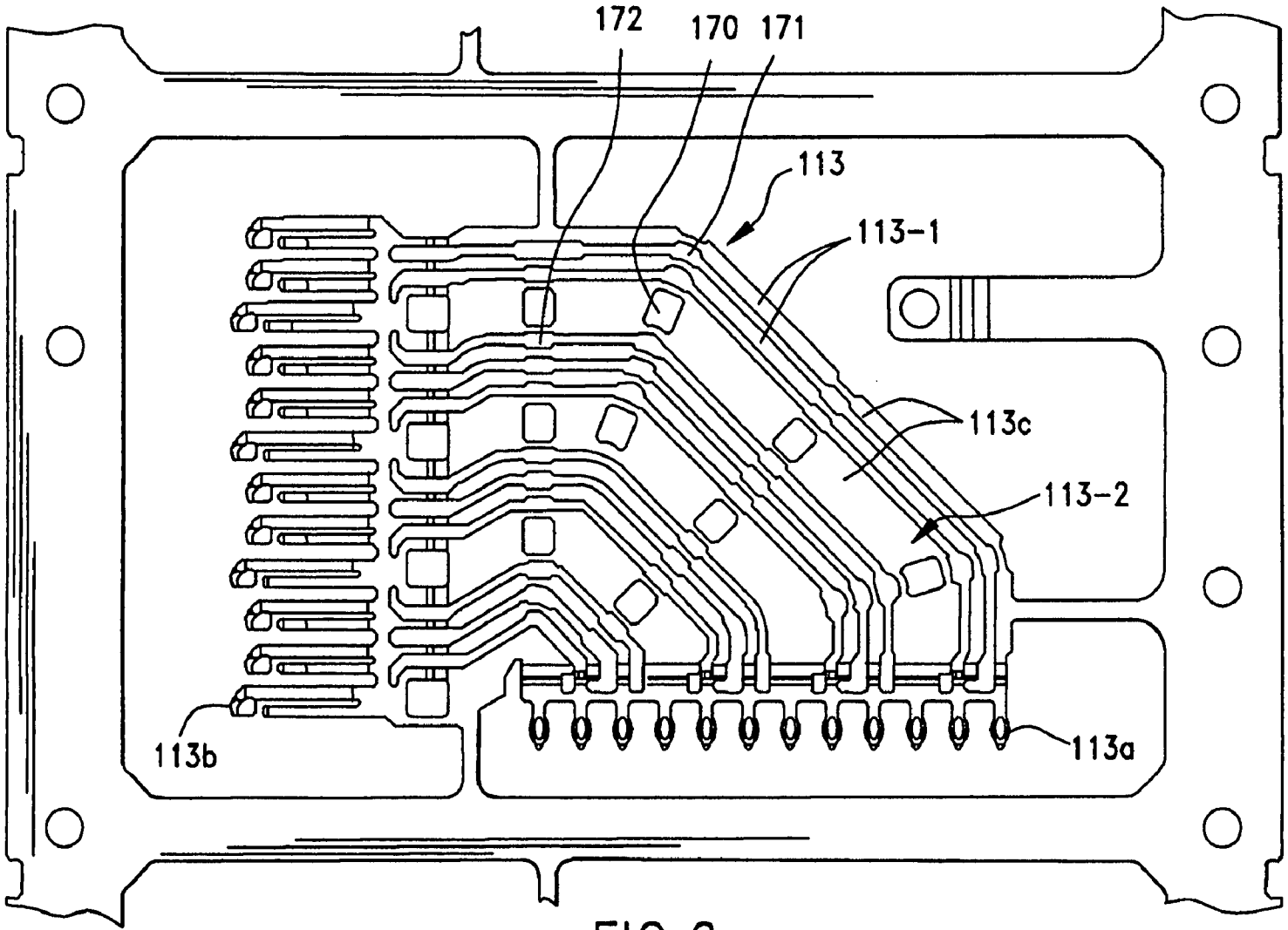
FIG. 6 is a plan view of the terminal assembly used in each half of the connector unit of FIG. 4, shown held in a metal lead frame and prior to singulation and overmolding thereof.
Figure 9:
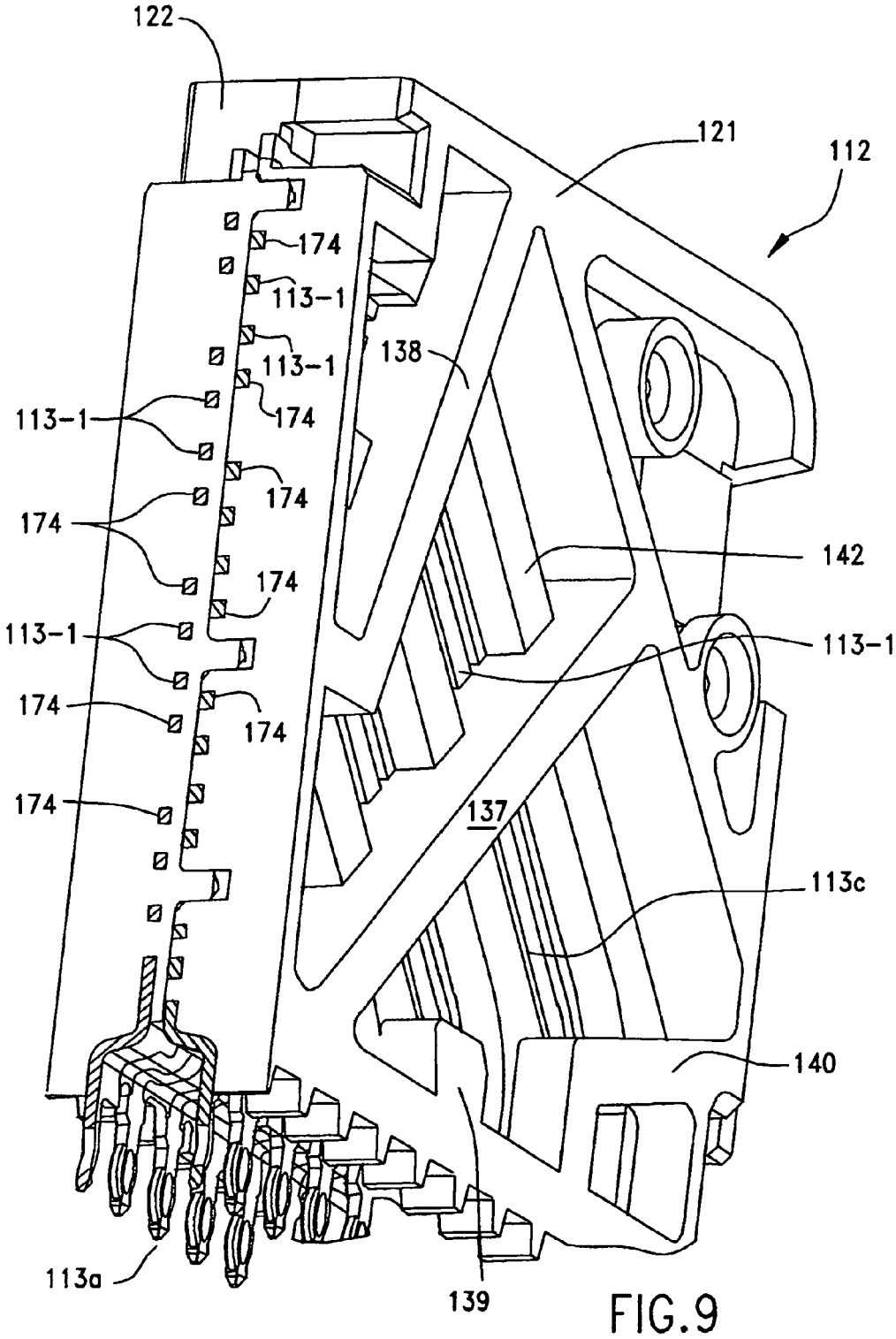
FIG. 9 is a sectional view of the daughter card connector of FIG. 2, taken along lines 9-9 thereof which is a vertical line aligned with the front vertical spoke, illustrating the arrangement of the terminals as they pass though a support frame spoke of the connector unit frame.

FIG. 4 further shows an additional vertical spoke 135 that is spaced apart forwardly of the front spoke 133 and is joined to the connector unit 122 by way of extension portions 134. This additional vertical spoke encompasses the terminals at the areas where they transition from the terminal body portions to the terminal contact portion 113*b*. In this transition, the large ground shield terminals are reduced down in size to define the bifurcated format of the terminal contact portions 113*b* as shown best in FIGS. 6 and 9.

As shown in FIG. 5A, the radial spokes 133, 135, 137, 138, 139 and 140 may be considered as partially continuing on the interior surface 150 of one of the connector unit wafer halves 122. These elements serve as stand-offs to separate the columns of two terminals 113 apart from each other when the two connector unit wafer halves 121, 122 are married together to form a connector unit 112. The interior surface 150 in FIG. 5A illustrates 6 such spoke elements. One is a base interior spoke 131' that intersects with front vertical interior spoke 133 at the junction "O". Another interior spoke 137' extends as a bisecting element in a diagonal path generally between two opposing corners of the connector unit wafer half 122. Two other radial, interior spokes 138', 140' extend between the bisecting interior spoke 137' and the base and front interior spokes 131' and 133'. In the preferred embodiment illustrated, the other radial interior spokes 138', 140' are positioned between the radial interior spoke 137' and the base and front interior spokes 131' and 133' so as to define two V-shaped areas within each connector unit 112 in which air is free to circulate. The connector unit wafer half 122 is preferably provided with a means for engaging the other half and is shown in the preferred embodiment as a plurality of posts 154. The posts 154 are formed in the area where the differential signal terminals are narrowed, and oppose the ground shield terminal windows 170. Each spoke member contains a corresponding recess 155 that receives the posts 154. The inner spokes also serve to provide the desired separation SP between the columns of terminals 113 in the connector unit 112. In this regard, the inner spokes also serve to define two V-shaped air channels that are indicated by the arrows 160, 161 in FIG. 5A. Both of these V-shaped air channels are open to the exterior of the connector unit through the slots 163 that bound the topmost terminals in either of the connector unit wafer halves.

Figure 5B:
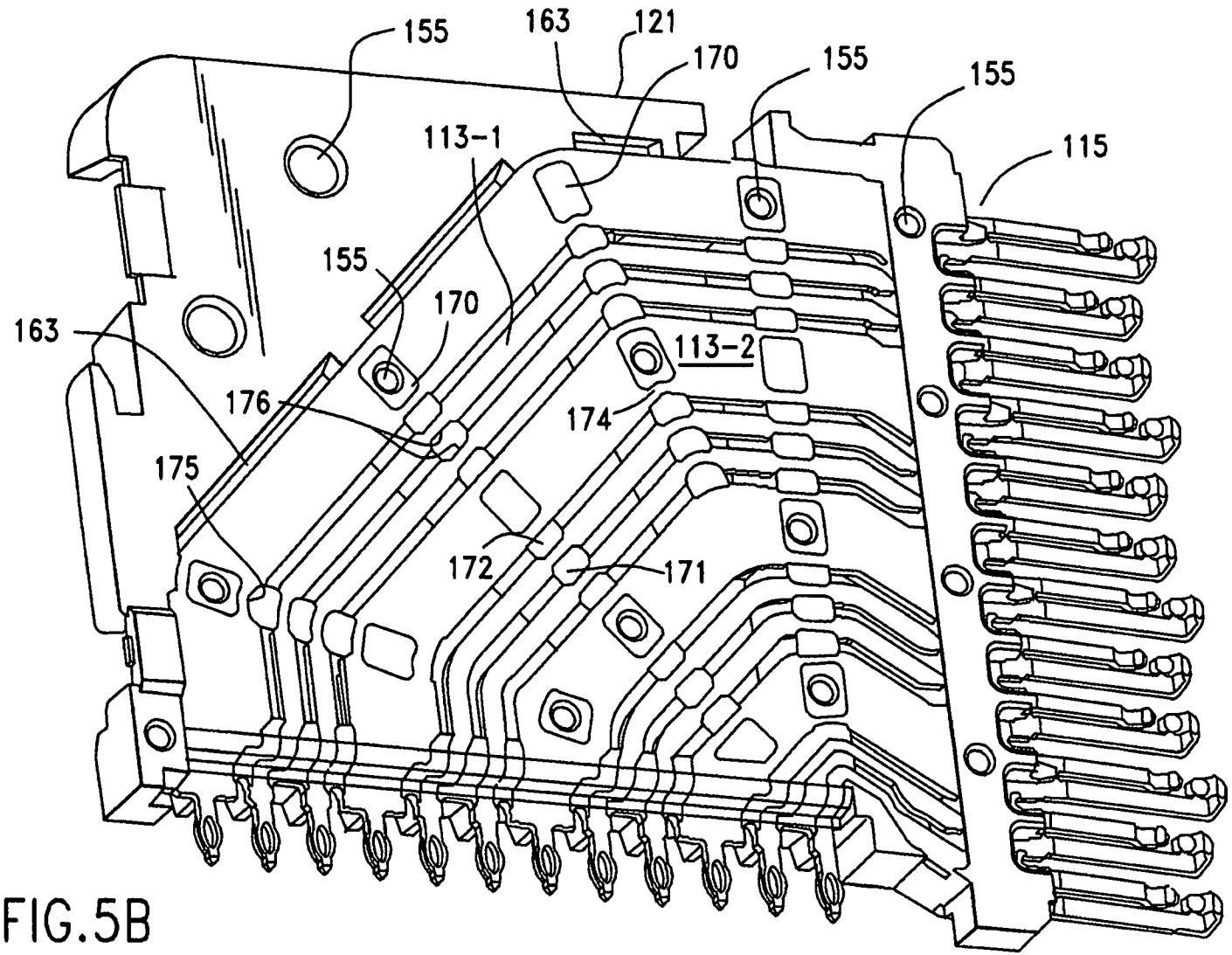
FIG. 5B is an interior view of the left hand wafer half of the connector unit of FIG. 4.

The opposing connector unit wafer half 121 as shown in FIG. 5B, includes a plurality of recesses, or openings, 155 that are designed to receive the posts 154 of the other wafer half 122 and hold the two connector unit wafer halves 121, 122 together as a single connector unit 112. In the areas where the two connector halves 121, 122 are joined together the impedance of the connector units 112 is controlled by reducing the amount of metal present in the signal and ground terminals 113-1, 113-2. This reduction is accomplished in the ground shield terminals 113-2 by forming a large, preferably rectangular window 170 in the terminal body portion 113*c* that accommodates both the posts 154 and the plastic of the connector unit support frame halve. Preferably, these windows have an aspect ratio of 1.2, where one side is 1.2 times larger than the other side (1.0). This reduction is accomplished in the signal terminals by "necking" the signal terminal body portions 113*c* down so that two types of expanses, or openings 171, 172 occur between the differential signal terminal pair and the terminals 113-1 of that pair and the ground shield terminal 113-2, respectively. The narrowing of the terminal body portions in this area increases the edge to edge distance between the differential signal terminal pair, which thereby affects the coupling of the terminals, as explained below.

Figure 13:
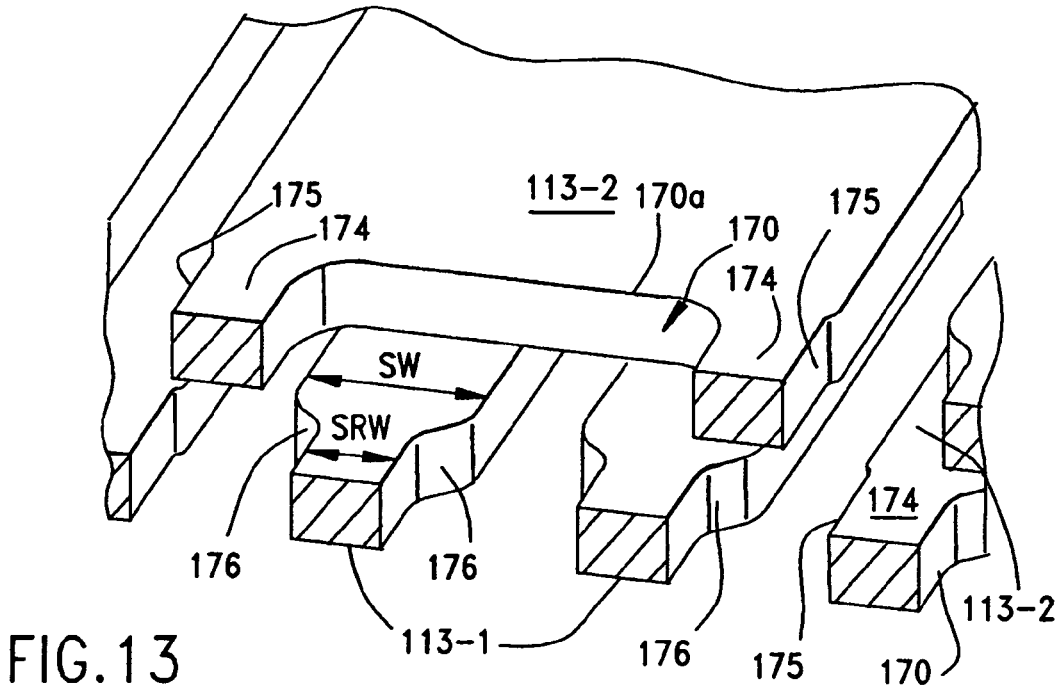
FIG. 13 is a sectioned view of the area of FIG. 12, illustrating the relative positions of the signal pair and ground shield terminals in the area where they are joined to the support frame of the two wafer halves.
Figure 14:
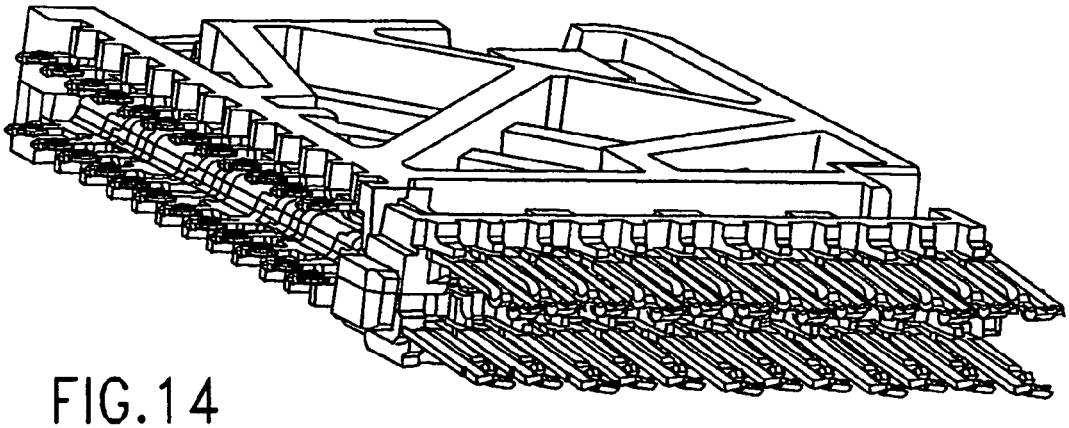
FIG. 14 is perspective view of a connector unit of the present invention used in the connector of FIG. 2, and turned upside down for clarity purposes in order to illustrate the ends of the body portions of the terminals and the tail portions that extend therefrom
Figure 15:
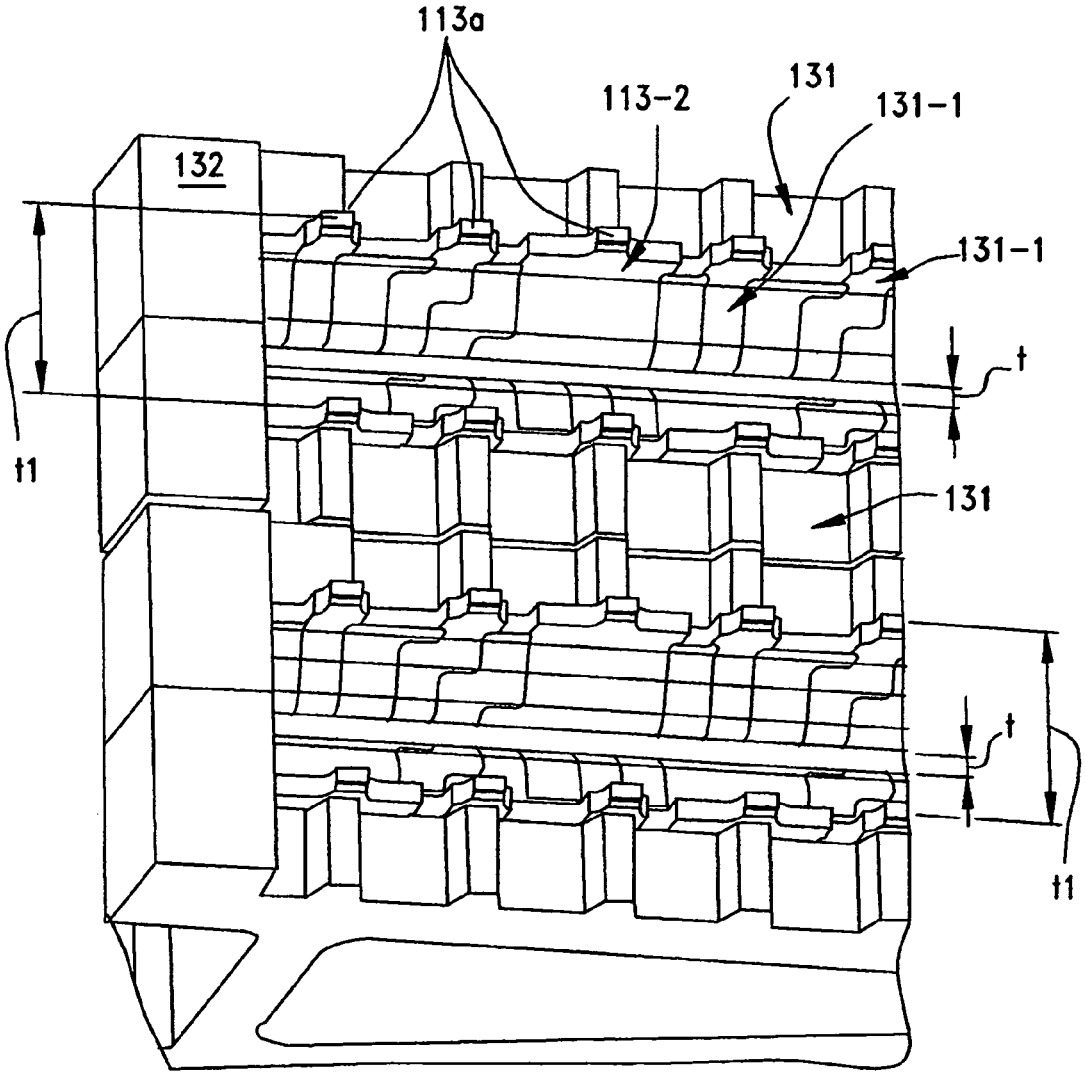
FIG. 15 is an enlarged detail view of the bottom of two connector units of the present invention illustrating the tail portions as they extend away from the terminal body portion ends.
Figure 16:
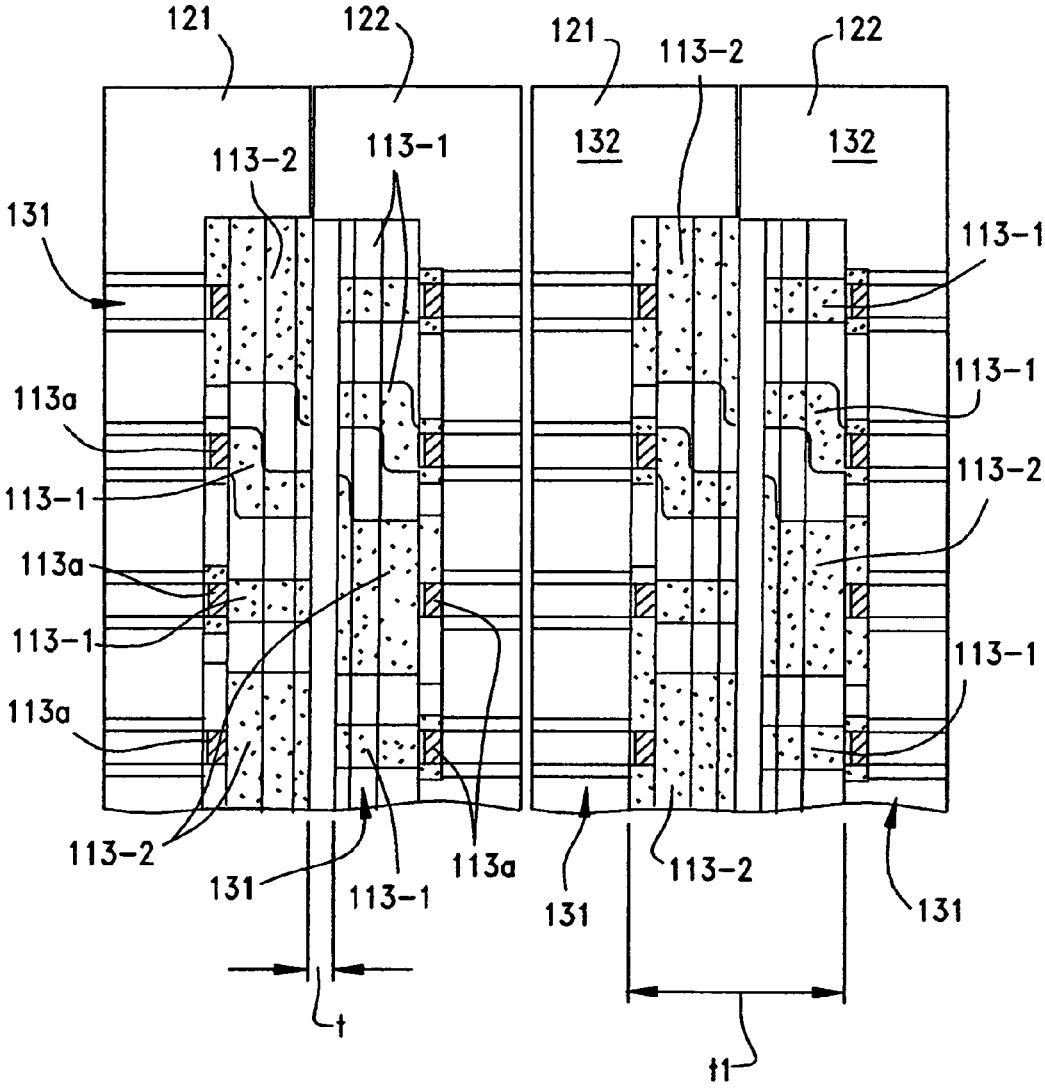
FIG. 16 is a bottom plan view of FIG. 15.
Figure 17:
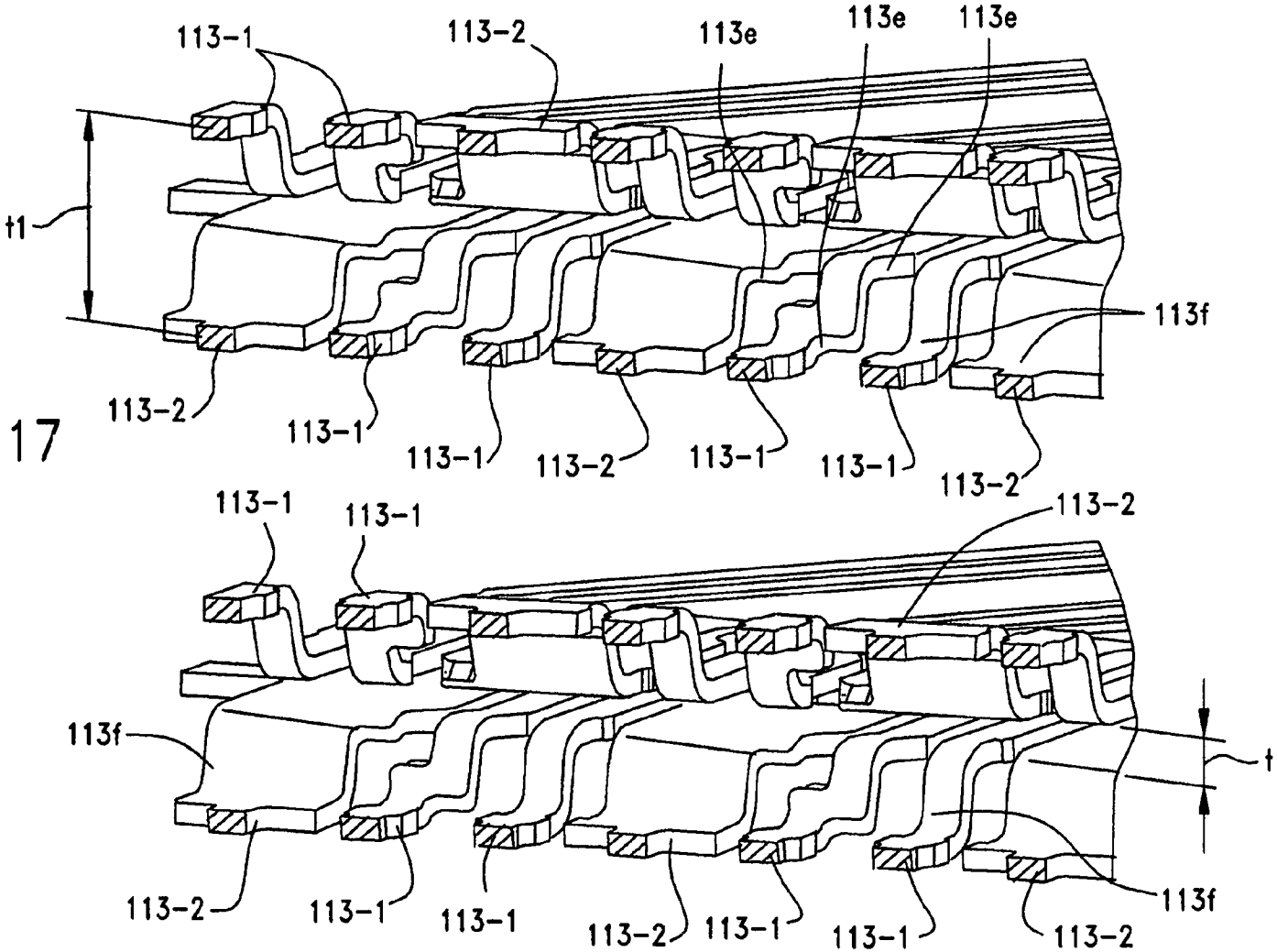
FIG. 17 is the same view as FIG. 15 but with the connector unit support frame removed for clarity.
Figure 18:
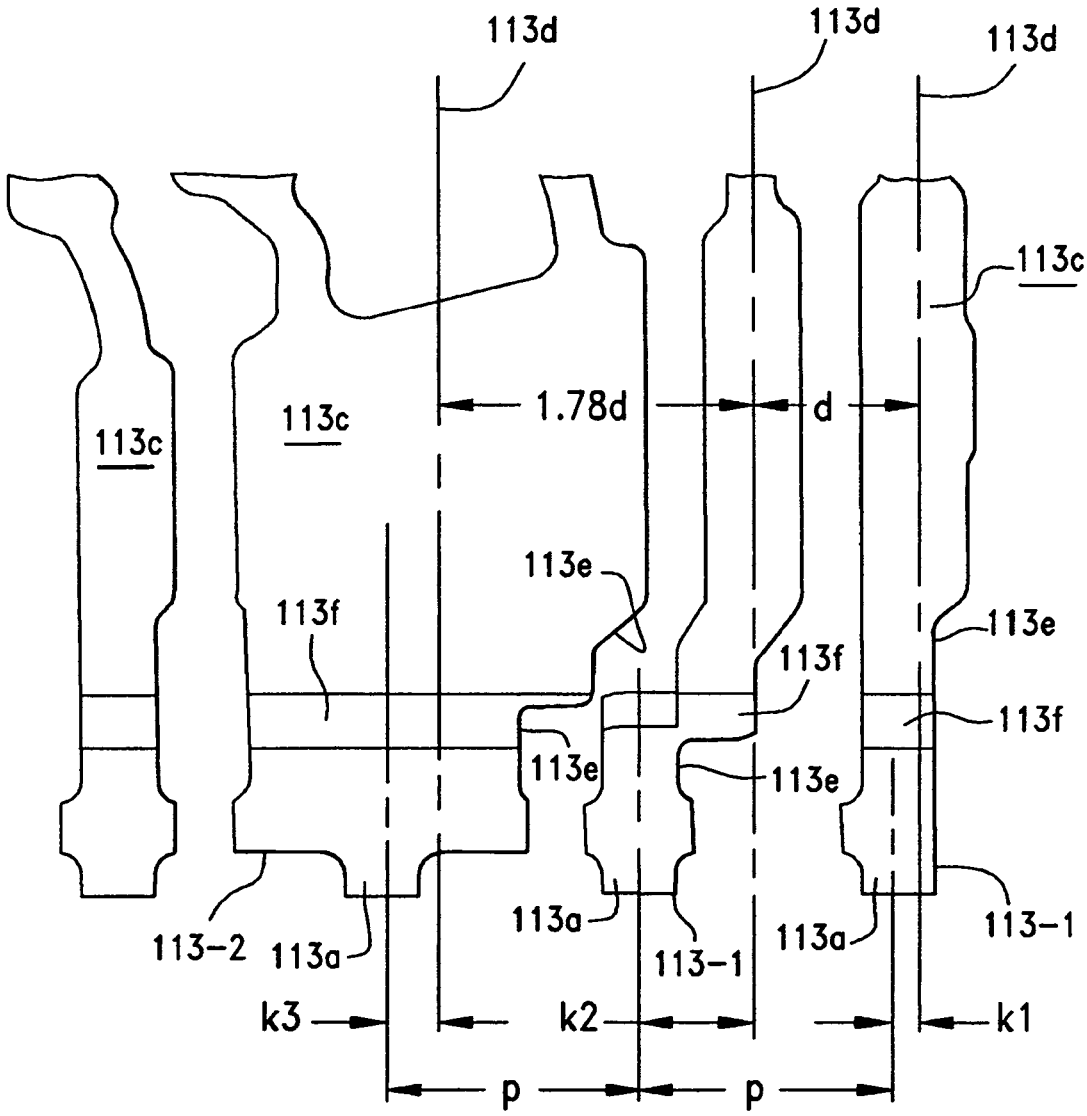
FIG. 18 is an enlarged detail view of the area where the terminal body portions meet the tail portions of the connectors of the invention.

The window 170 is formed within the edges of the ground shield terminal 113-2 and the terminal extent is continued through the window area by two sidebars 174, which are also necked down as seen best in FIG. 13. Preferably, the window 170 exhibits an aspect ratio (height/width) of 1.2. The necking between the ground shield terminals 113-2 and the adjacent differential signal terminal 113-1 is defined by two opposing recesses that are formed in the edges of the signal and ground shield terminals 113-1, 113-2. As shown in the section view of FIG. 13, recesses 175 are formed in the opposing edges of the ground shield terminal 113-2 in the area of the window 170 and may slightly extend past the side edges 170*a* of the windows 170. Other recesses 176 are formed in the edges of the signal terminals 113-1 so that the width of the signal terminals 113-1 reduces down from their normal body portion widths, SW to a reduced width at the windows, RSW. The width of the necked opening NW (FIG. 12) between the two terminals of the differential signal pair is preferably equal to or greater than the signal terminal width SW and preferably the necked width is no more than about 10% greater than the signal terminal width.

This structural change is effected so as to minimize any impedance discontinuity that may occur because of the sudden change in dielectric, (from air to plastic). The signal terminals 113-1 are narrowed while a rectangular window 170 is cut through the ground shield terminals 113-2. These changes increase the edge coupling physical distance and reduce the broadside coupling influence in order to compensate for the change in dielectric from air to plastic. In the area of the window, a portion of the metal of the large ground shield terminal is being replaced by the plastic dielectric in the window area and in this area, the widths of the signal terminals 113-1 are reduced to move their edges farther apart so as to discourage broadside coupling to the ground shield terminal and drive edge coupling between the differential signal terminals 113-1. This increase in edge spacing of the signal terminals 113-1 along the path of the open window 170 leads the differential signal terminal pair to perform electrically as if they are spaced the same distance apart as in their regular width portions. The spacing between the two narrowed signal terminals is filed with plastic which has a high dielectric constant than does air. The plastic filler would tend to increase the coupling between the signal terminal pair at the regular signal terminal pair edge spacing, but by moving them farther apart in this area, electrically, the signal terminal pair will operate as if they are the same distance apart as in the regular area, thereby maintaining coupling between them at the same level and minimizing any impedance discontinuity at the mounting areas.

Figure 19:
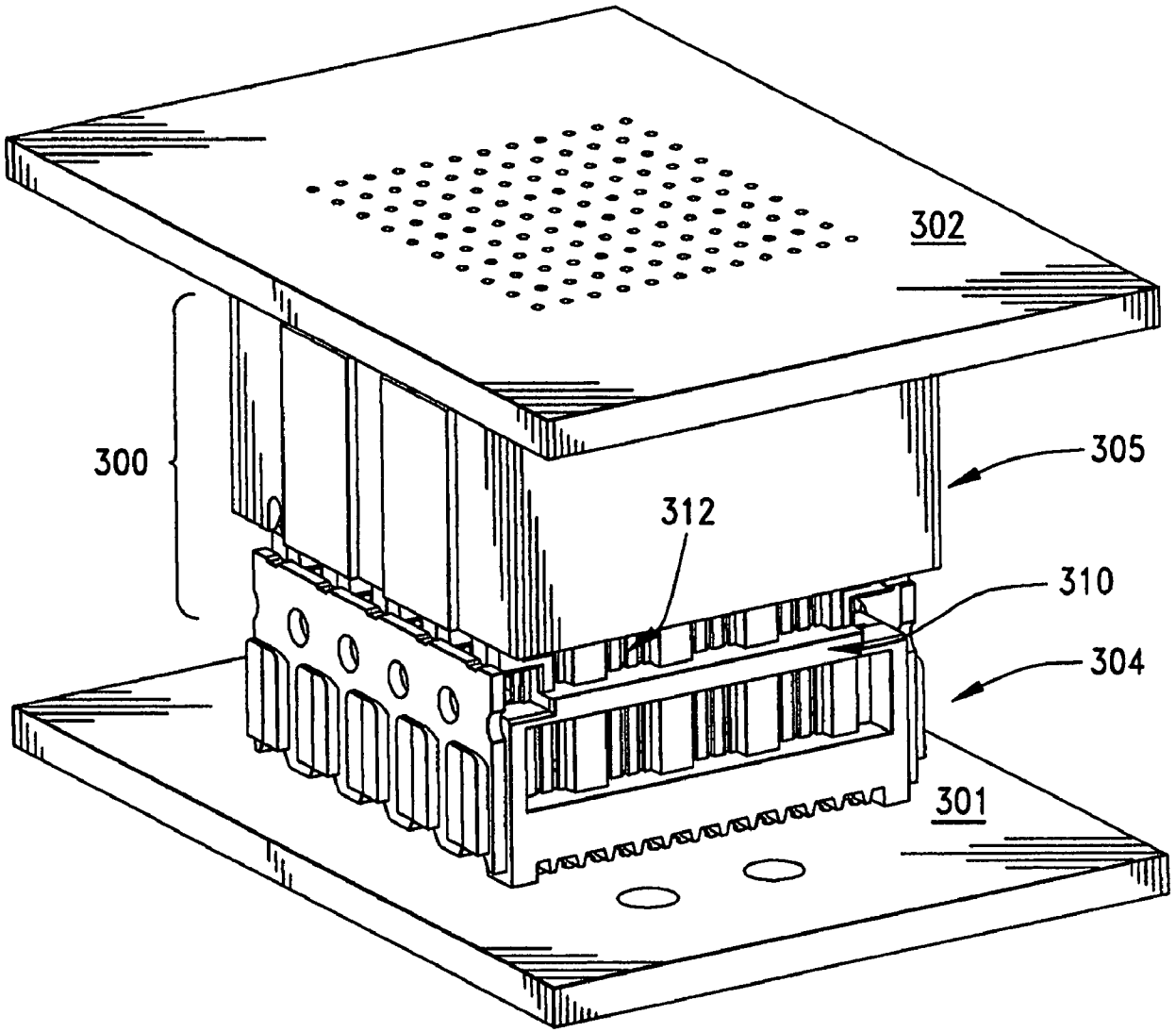
FIG. 19 is a perspective view of a second embodiment of a connector constructed in accordance with the principles of the present invention which is a mezzanine style connector that is utilized to support one circuit board above another circuit board.
Figure 20:
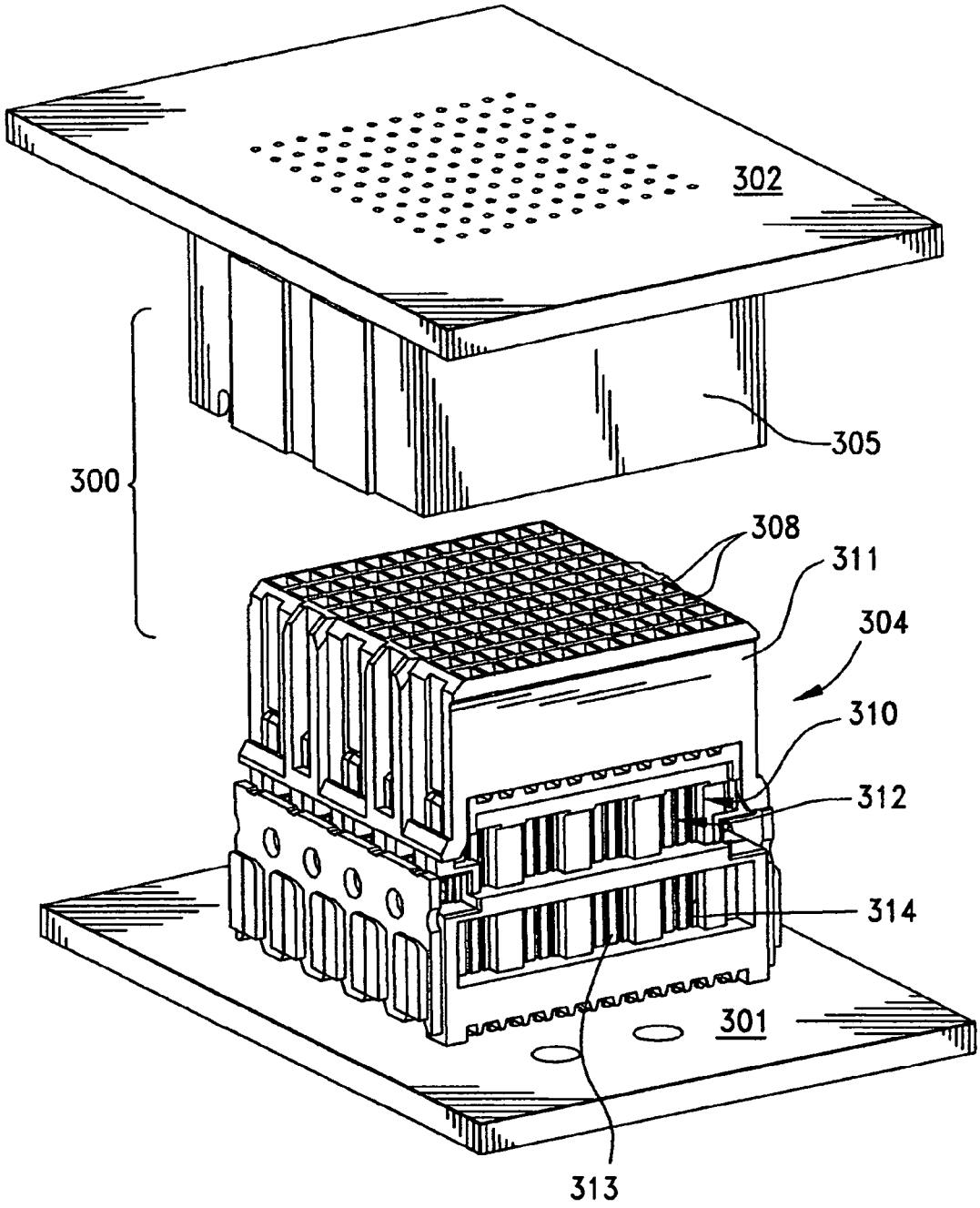
FIG. 20 is the same view as FIG. 19, but with the plug and receptacle members thereof separated apart from each other.
Figure 21:
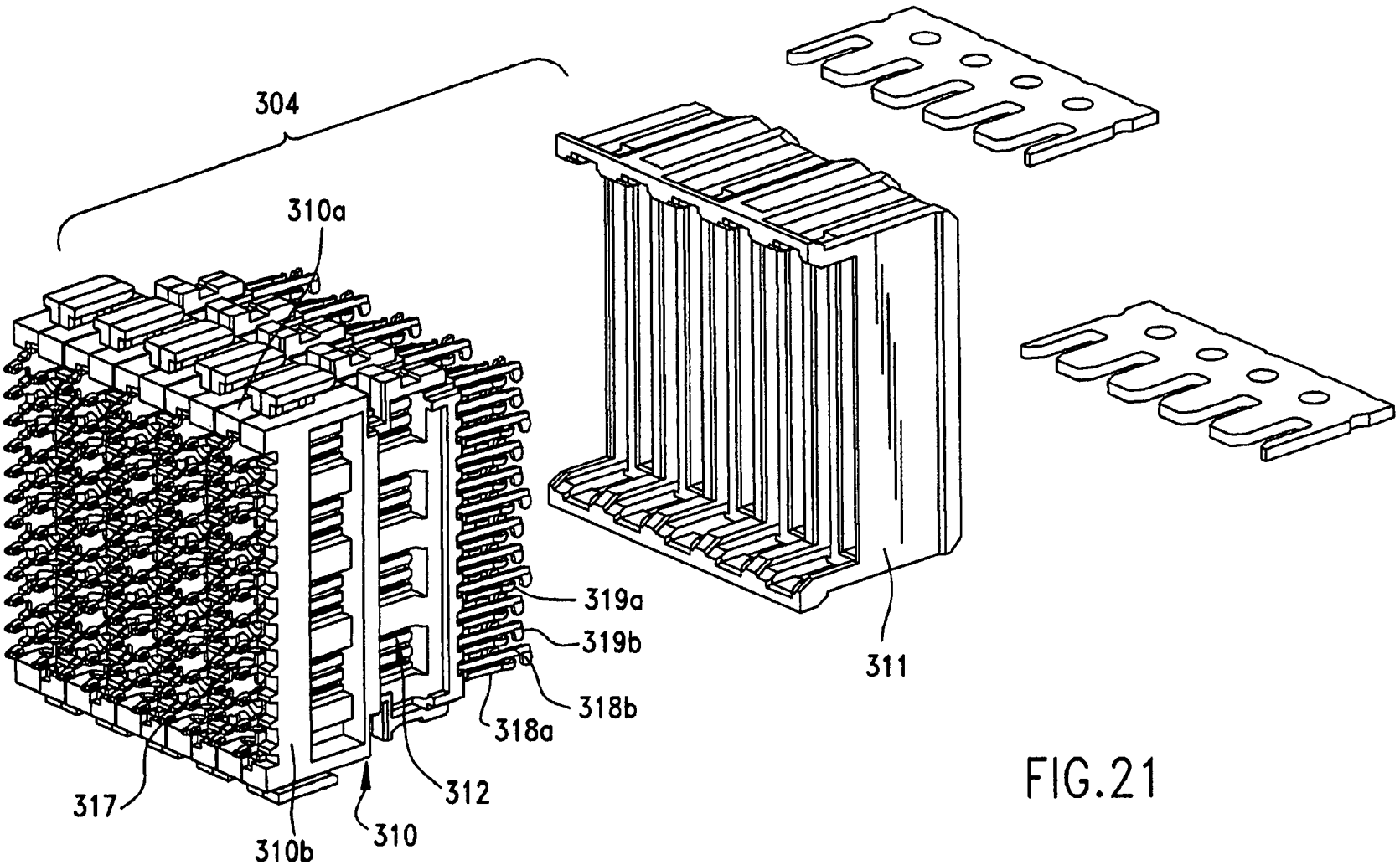
FIG. 21 is the same view as FIG. 20, but with the circuit boards removed and the plug member clips removed for clarity.

FIGS. 19-27 illustrate another embodiment of the present invention in which the connector structure is of the mezzanine style. As shown in FIG. 19, such a mezzanine connector assembly 300 is used to join together two circuit boards 301, 302 with one of the circuit boards 302 being mounted above and preferable parallel to the other circuit board 301. As shown in FIG. 20, the connector assembly 300 typically includes a plug member connector 304 that mates with and is received within a corresponding receptacle connector 305. The plug connector 304 includes a plurality of connector elements 310, which may be considered as wafers, that are assembled together in a group and placed within a cover member, or shroud 311 that has individual openings 308 which are aligned with the contact portions of the terminals of the plug connector 304.

Figure 22:
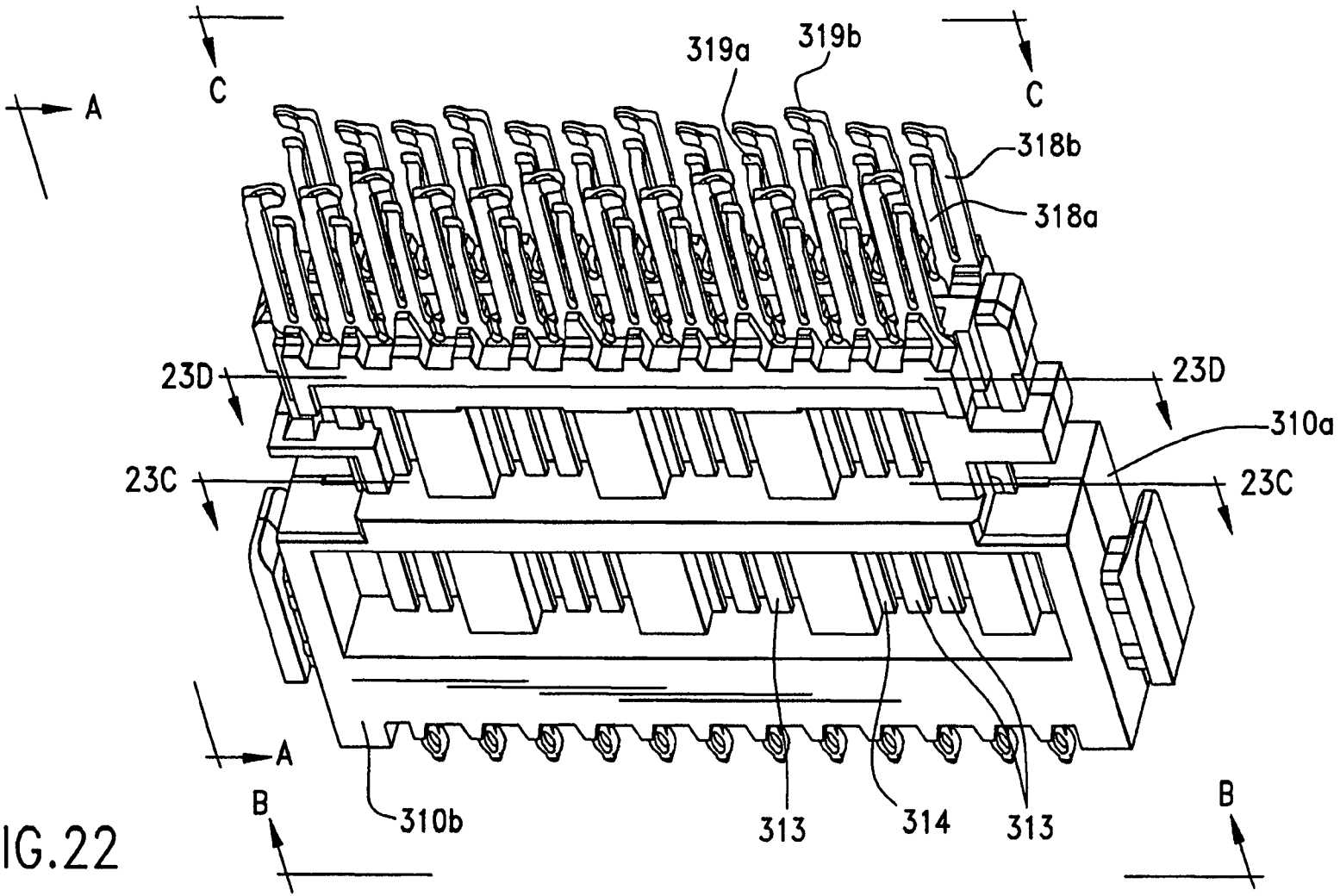
FIG. 22 is a perspective view of a wafer used in the mezzanine connector of FIG. 19.
Figure 23A:
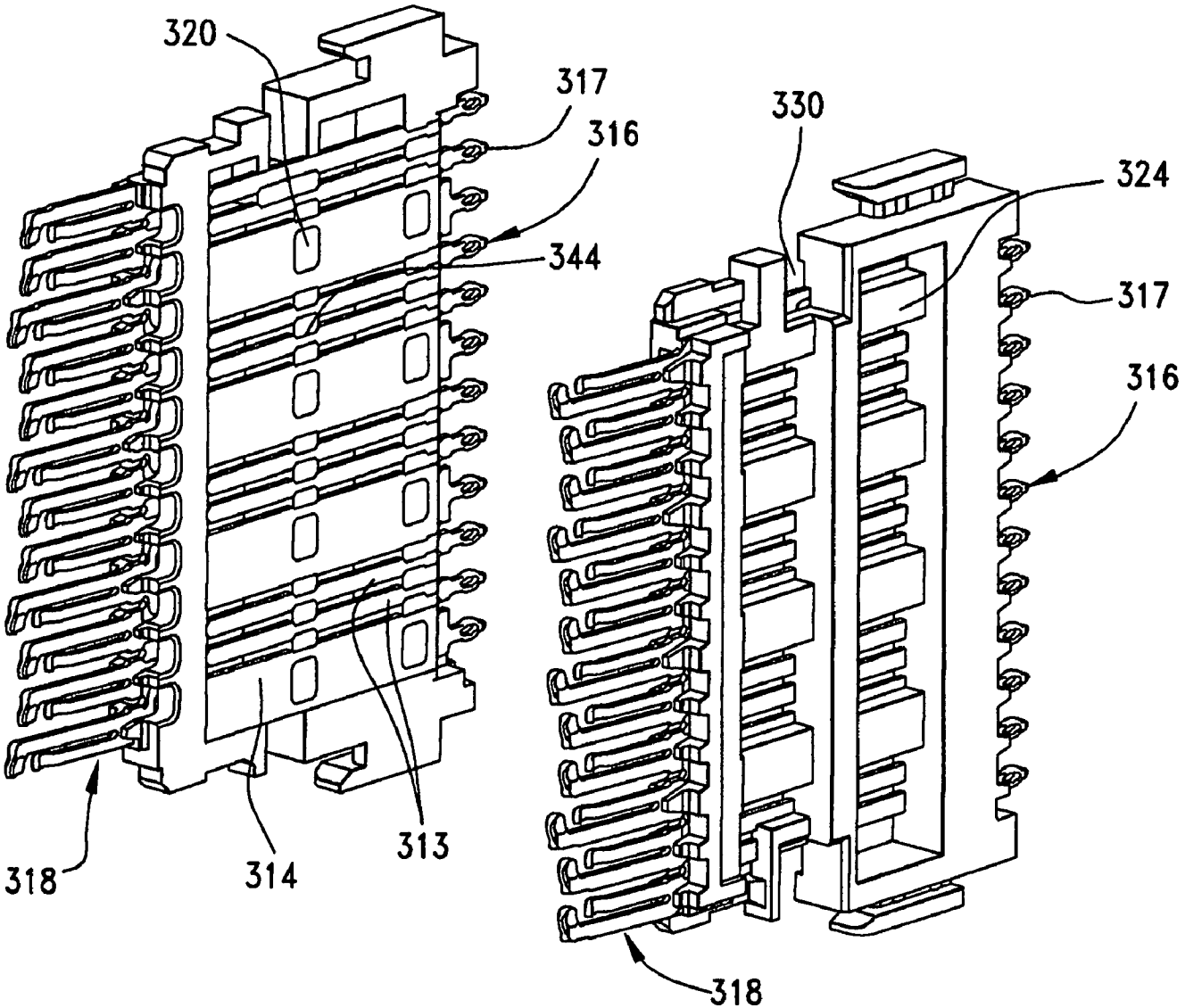
FIG. 23A is the same view as FIG. 22, but with the two wafers parts separated to show the interior of one of the two wafer parts.
Figure 23B:
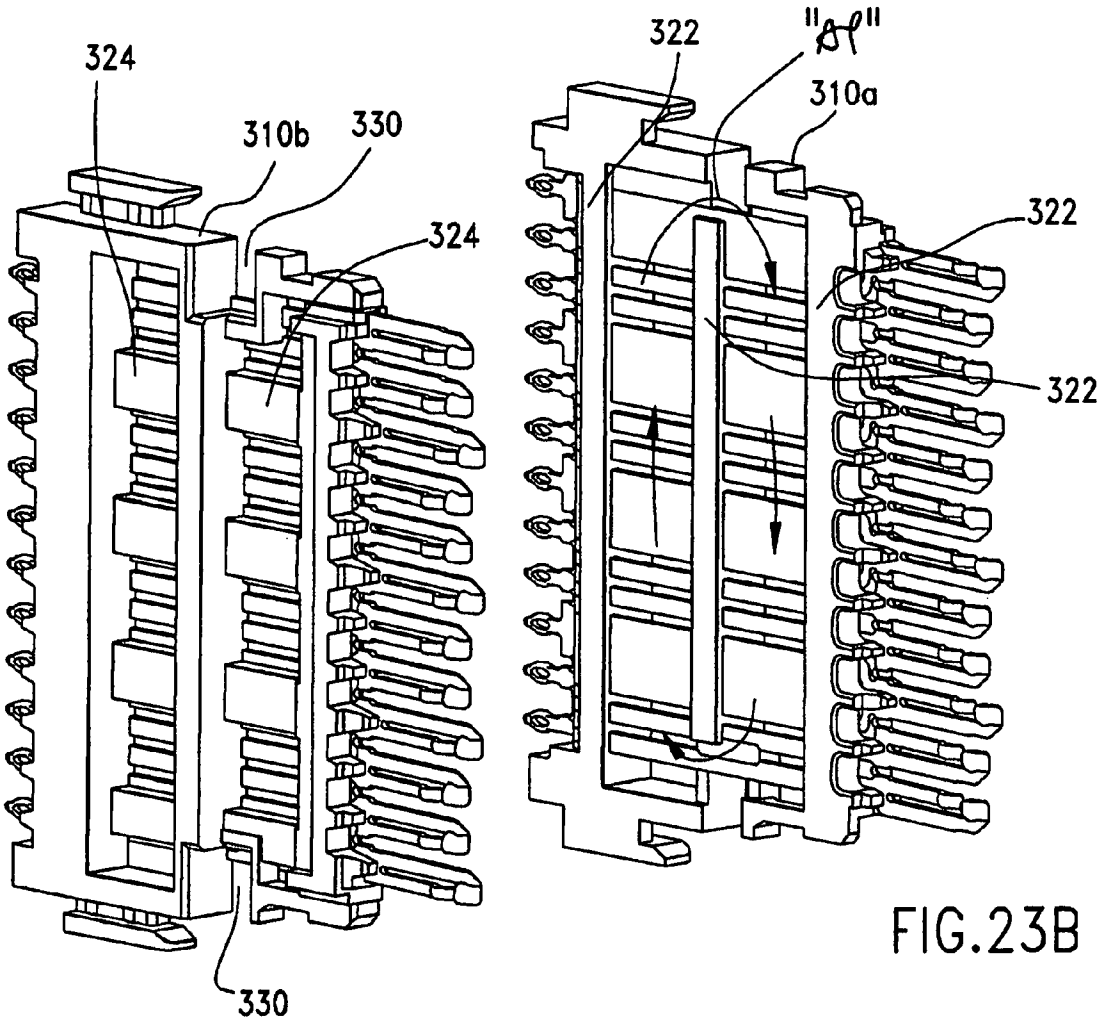
FIG. 23B is the same view as FIG. 23A, but taken from the opposite side thereof to show the interior of the other of the two wafer parts.
Figure 24B:
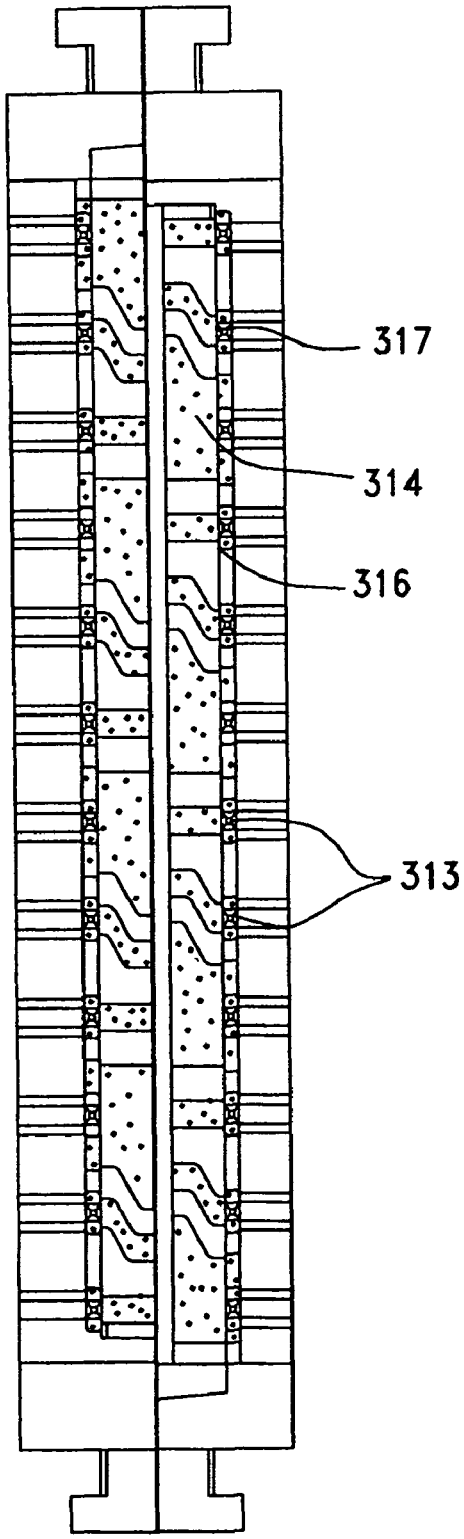
FIG. 24B is a bottom plan view of the connector wafer of FIG. 22, taken along lines B-B thereof.
Figure 24A:
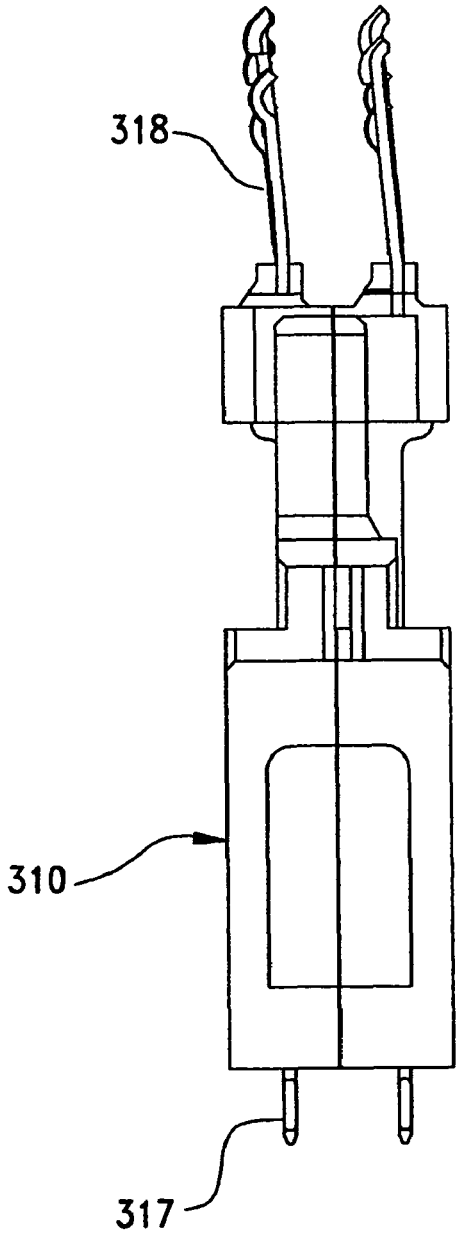
FIG. 24A is an end elevational view of the connector wafer of FIG. 22, taken along lines A-A thereof.
Figure 24D:
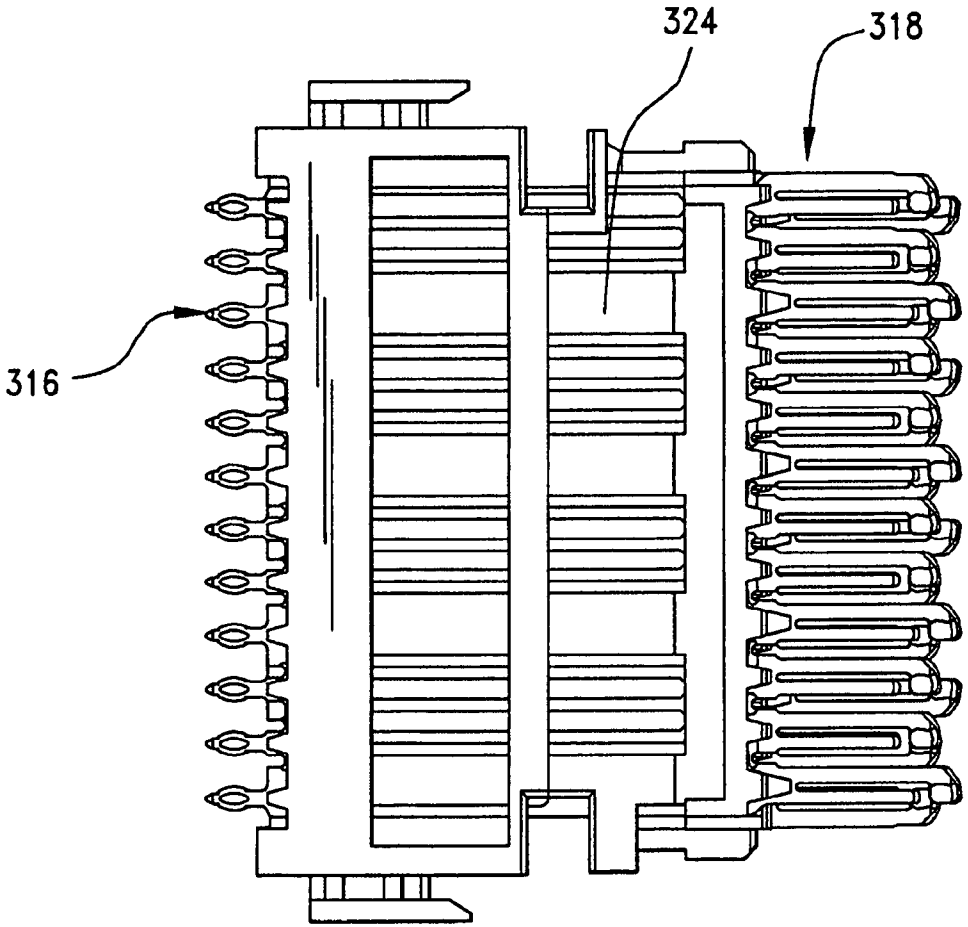
FIG. 24D is a side elevational view, widthwise, of the connector wafer of FIG. 22.
Figure 24C:
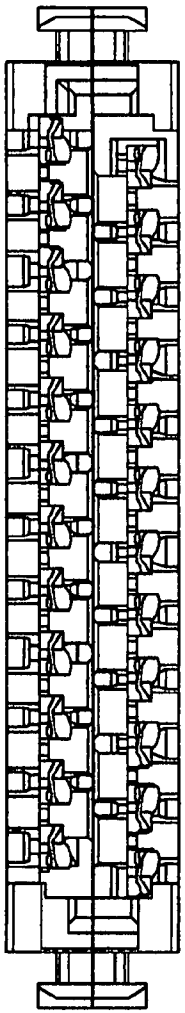
FIG. 24C is a top plan view of the connector wafer of FIG. 22, taken along lines C-C thereof.
Figure 25:
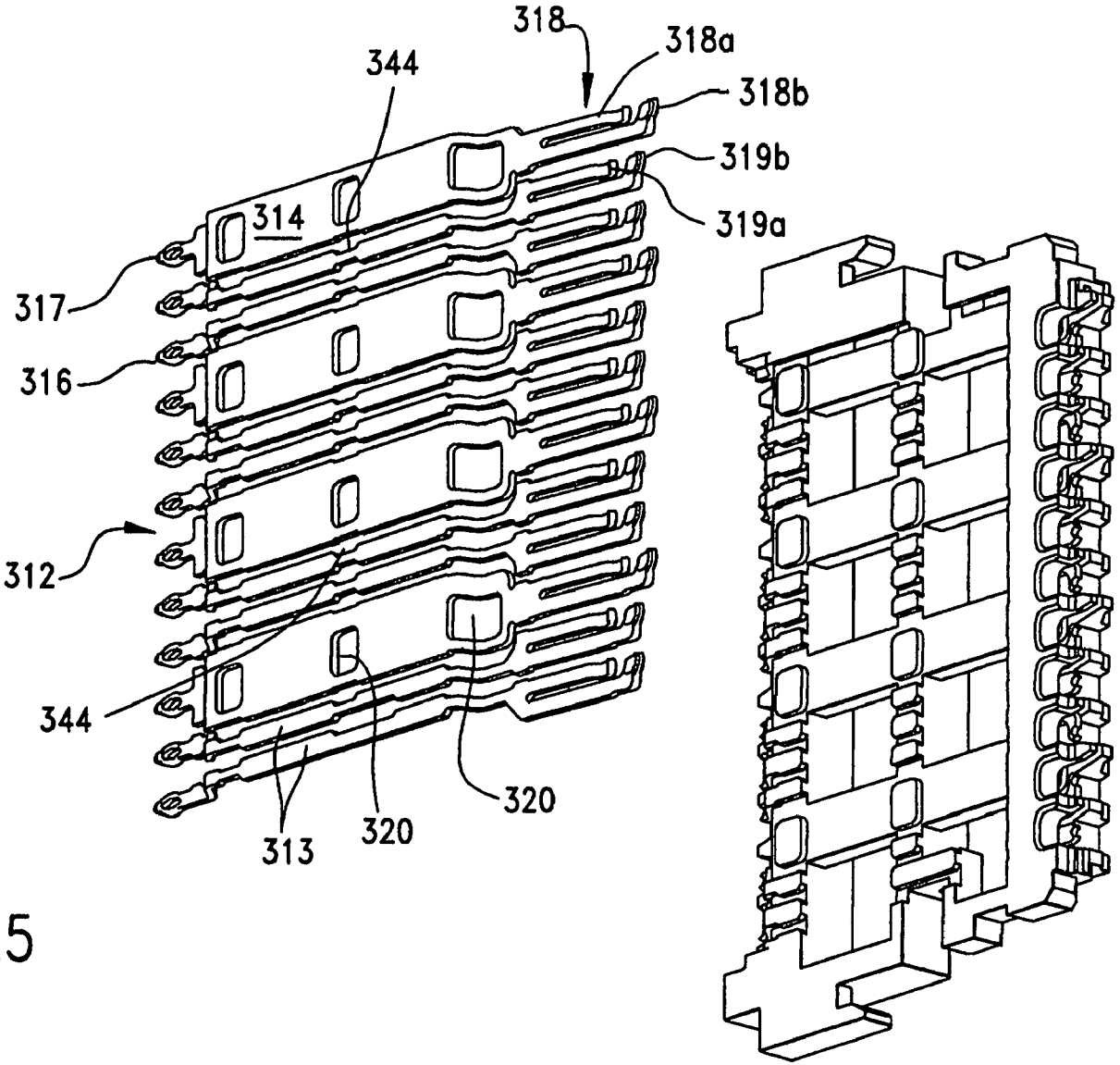
FIG. 25 is an exploded view of one of the wafer parts of FIG. 22, showing the terminals thereof removed from their insulative housing.

Each such connector element, or wafer 310 is preferable formed from two halves, or parts 310*a*, 310*b* (FIG. 23A). Each half, or part 310*a*, 310*b* supports a plurality of conductive terminals 312 that are divided into two distinct types of terminals: thin terminals 313 that are used for signal transmission within the connector and thick terminals 314 that are used to provide a ground within the connector. Each terminal 312 includes a tail portion 316 that is formed as a compliant pin 317 at one end and a pair of contact arms 318*a*, 318*b* at the other end of the terminals. The contact arms 318*a*, 318*b* have free ends with curved contact portions 319*a*, 319*b*, these contact portions 319*a*, 319*b* are aligned with each other along a common line of contact "LOC" as shown best in FIG. 26A. The bifurcated nature of the contacts and their linear (or axial) alignment provides for a redundant contact to be effected upon mating of the two connector members 314, 305 together. The bifurcated contacts are reversed as between wafers, i.e., as shown in FIG. 22, the contacts of one wafer half 310*b* are "hooked" to the right of the drawing and the contacts of the other wafer half, 310*a*, are hooked to the left side of the drawing. This reduces the mating force required for the connectors. Additionally, as shown in FIG. 24A, the contact surfaces of the bifurcated contacts of both wafer halves, 310*a*, 310*b*

Figure 23C:
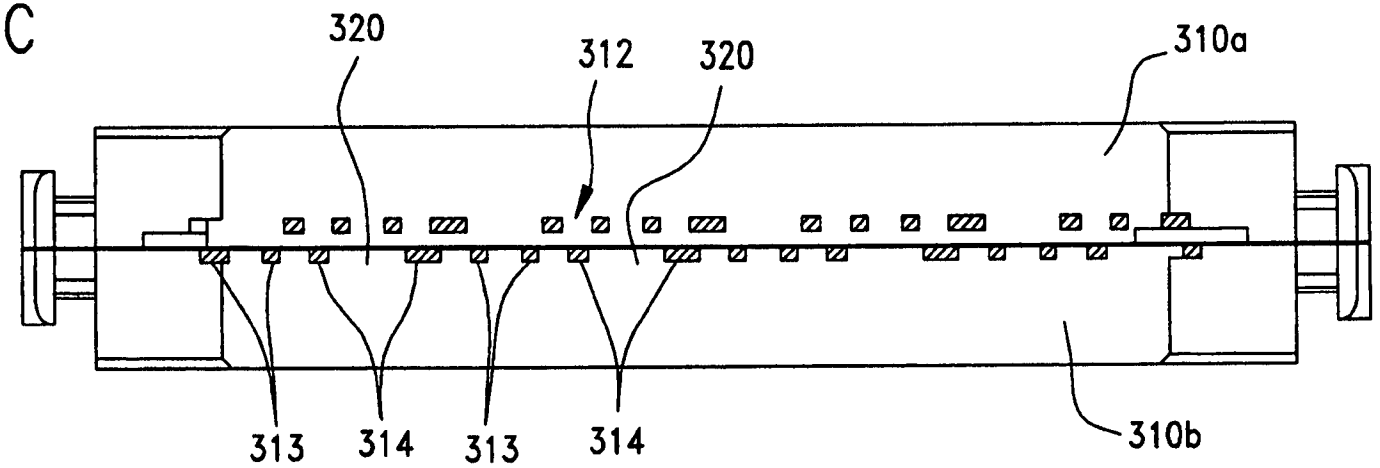
FIG. 23C is a cross-sectional view of the connector wafer of FIG. 22, taken along lines 23C-23C thereof.
Figure 23D:
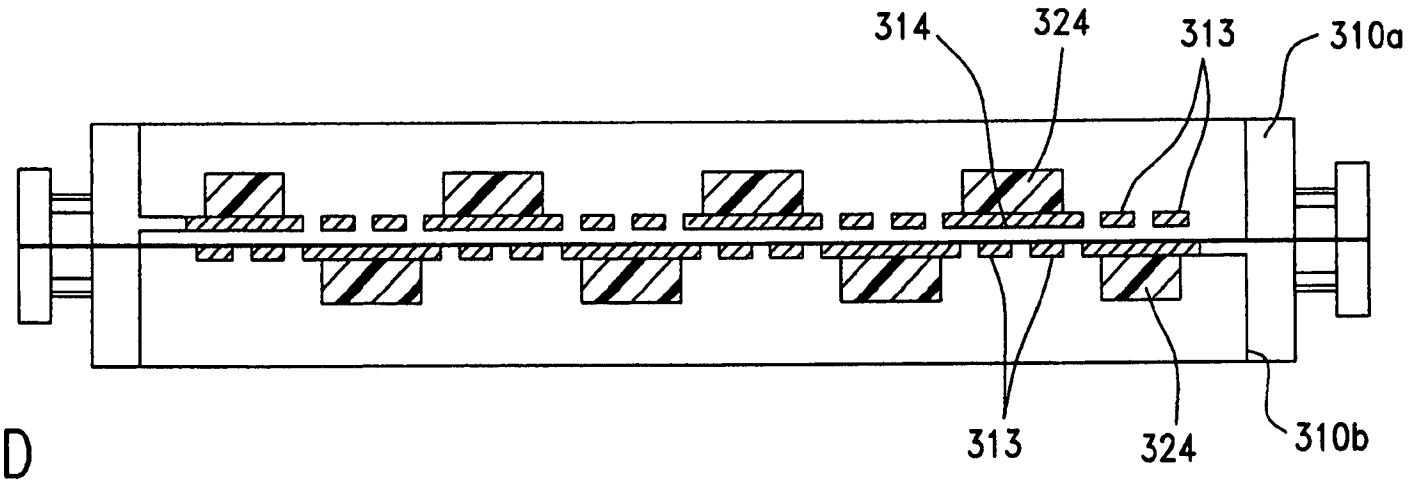
FIG. 23D is a cross-sectional view of the connector wafer of FIG. 22, taken along lines 23D-23D thereof.

Each wafer part 310*a*, 310*b* is preferably formed from an insulative material, such as a resin and may be either molded over the terminals 312 or the terminals 312 inserted into a mold and the wafer parts molded there around, i.e. insert molded. The terminals 312 are arranged in the same order as the right angle connector of FIGS. 7A and 7B, namely a thick, or larger ground shield terminal 314 and then two signal terminals 313. Each wafer half may be considered as supporting an away of terminals 312 that is arranged in a line within the wafer half. As shown in FIG. 23D, the two terminal arrays are arranged such that the thick ground shield terminal 314 opposes a pair of thin signal terminals. This pattern of terminals is maintained in a line, rather than in a column, as noted in the first embodiment.

As noted with the first embodiment, the terminals 312 of the wafer halves 310*a*, 310*b* are arranged in an alternating fashion so that the wide ground terminals 314 of the wafer half 310*b* face a pair of signal terminals 313 of the opposing wafer half 310*a*. In this manner, the pairs of signal terminals 313 are driven to edge coupling within each pair and coupling with other signal pairs is determined. Each such pair of signal terminals 313 (with the exception of the signal pairs on the ends of each terminal away within the wafer halves) has ground terminals 314 that flank the edges of the signal pair and at least one ground facing the signal pair. The above structure is best explained with reference to FIGS. 23C & 23D, which shows the meandering or serpentine nature of the ground terminals 314 in the same manner as shown in FIG. 7B.

Figure 26B:
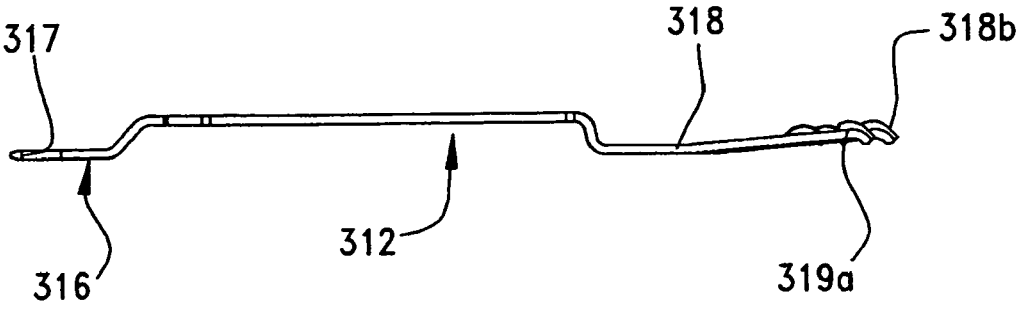
FIG. 26B is an end view of the terminal set of FIG. 26A taken along lines B-B thereof.
Figure 26A:
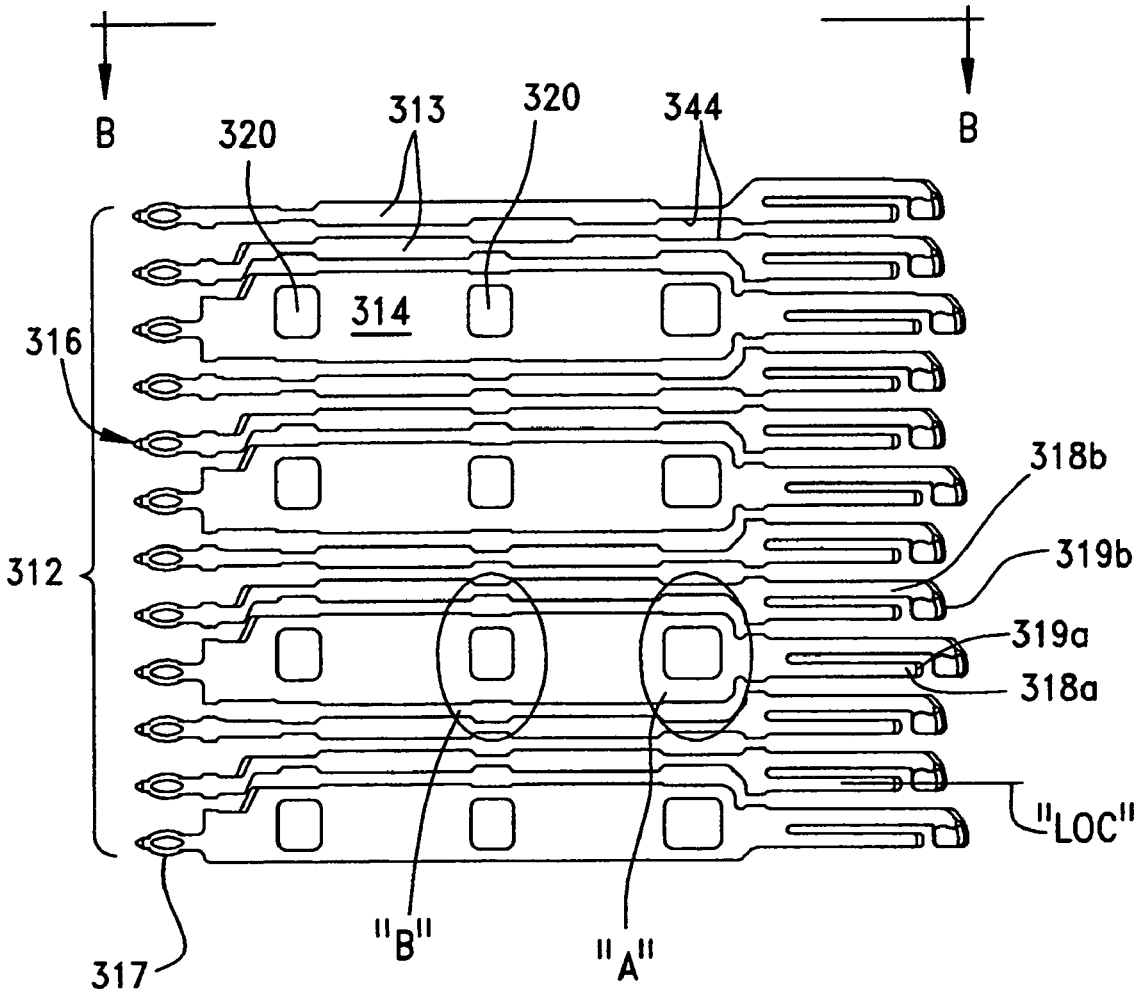
FIG. 26A is an elevational plan view of the terminal set of FIG. 25.
Figure 27:
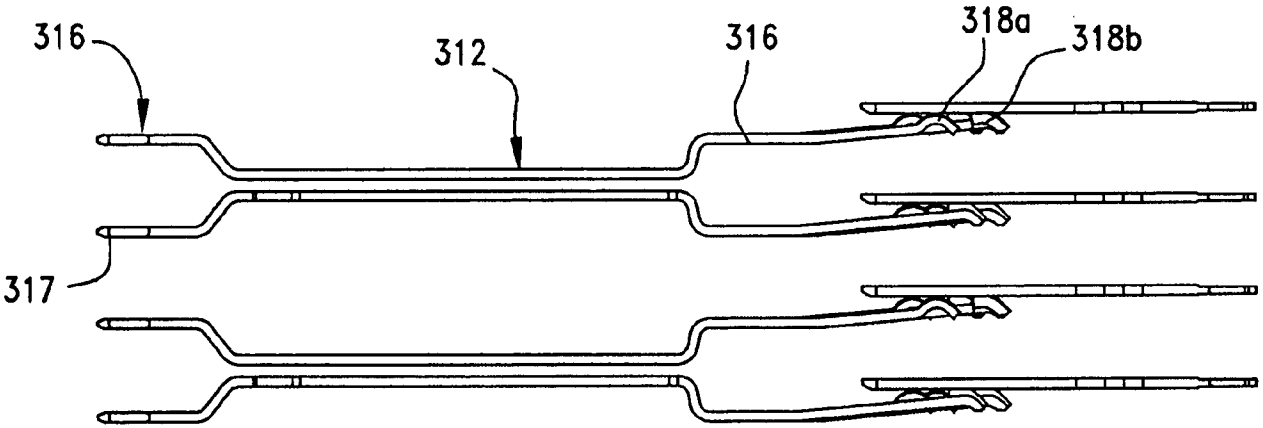
FIG. 27 is an end view illustrating the terminal sets of two wafer halves, removed from their housing for clarity and showing the spacing between the opposing terminals and their engagement pins with pins of a corresponding mating connector.
Figure 28B:
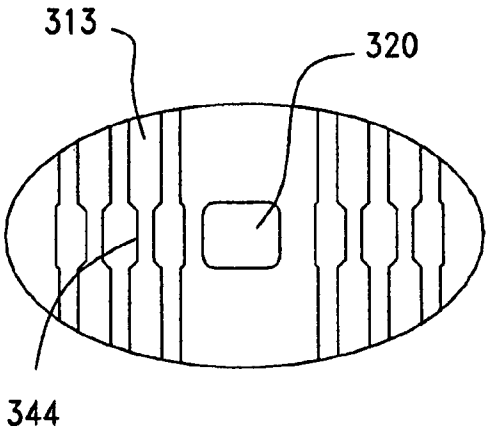
FIG. 28B is an enlarged detail view of area "B" in FIG. 26B.
Figure 28A:
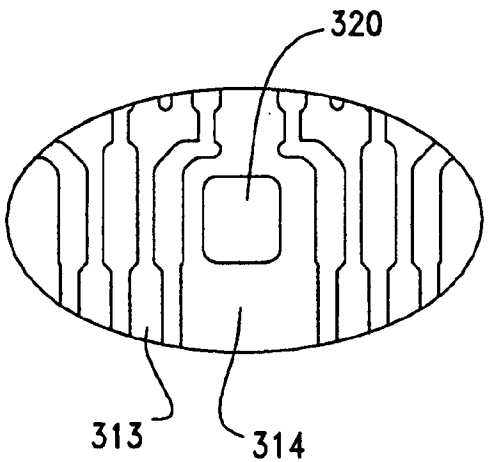
FIG. 28A is an enlarged detail view of area "A" in FIG. 26A.

The present invention also takes into account the reduction of metal in the terminals in the areas where the terminals are mounted to the connector unit frame. FIG. 23C shows in sectional view an area taken horizontally through the terminal array through the area of the ground terminal "window". FIGS. 28 A & B are enlarged detail views of areas "A" and "B" of FIG. 26A illustrating the ground terminal window 320 and the necking of the adjacent signal terminals. In both views the window is shown as offset from the ground terminal center so that the width of the side bars that define the edges of the window 320 are non-uniform in width. This is done in this embodiment in order to maintain a selected spacing of the terminal contact portions. It is preferable that the windows 320 have an aspect ratio of about 1.2 where one side of the opening is 1.2 times the other side (i.e.). The sides of the ground terminals 314 and the signal terminals 313 in this area are necked (reduced in their width) as explained in detail above.

In order to better hold the terminals 312 in place in the wafer halves as well as reduce the amount of metal in the terminal mounting areas, the ground terminals 314 are provided with openings formed therein that take the configuration of windows 320 that are disposed in the body portions of these terminals. These openings/windows 320, as explained with reference to the first embodiment, receive molding material during the formation of the wafer halves 310*a*, 310*b*. They also serve to modify the impedance of the terminals 312 in areas at which they are mounted to the wafer halves. Both the ground terminals 314 and signal terminals 313 are "necked" down in the edges thereof adjacent the openings 320. This is because of the presence of the molding plastic is that area, which has a different dielectric constant that the metal of the terminals. Additionally, in the facing wafer half 310*a*, as shown best in FIG. 23B, a plastic rib, or bar 322, is molded over the array of terminals crosswise, or transverse, of the longitudinal extent of the terminals. This rib 322 not only holds the terminals 312 in place but also serves as an additional impedance timing factor. Simply put, metal is removed from the terminals in the areas where the wafer plastic comes between the terminals 312 of each terminal array as well as between adjacent terminals in facing wafer halves (or within the connector wafer). The narrowing of the terminal body portions in this area increases the edge to edge distance between the differential signal terminal pair, which there by affects its coupling, as explained below. In the areas where the terminals are held in and by the plastic of the wafer 310, the terminals will have a configuration as shown in the right angle connector of FIGS. 12 and 13 and will operate in the manner described above.

The ground terminal window 320 is formed within the edges of the ground shield terminal 314 and the terminal extent is continued through the window area by two sidebars 340, which are also necked down as seen best in FIG. 29. Preferably, the ground terminal window 320 exhibits an aspect ratio (height/width) of 1.2. The necking between the ground shield terminals 314 and the adjacent differential signal terminals 313 is defined by two opposing recesses that are formed in the edges of the signal and ground shield terminals 313, 314. As shown in the sectional view of FIG. 30, recesses 342 are formed in the opposing edges of the ground shield terminal 314 in the area of the window 320. Other recesses 344 are formed in the edges of the signal terminals 313 so that the width of the signal terminals 313 reduces down from their normal body portion widths, SW to a reduced width at the windows, RSW. The width of the necked opening NW (FIG. 30) between the two terminals of the differential signal pair is preferably equal to or greater than the signal terminal width SW and preferably the necked opening is no more than about 10% greater than the signal terminal width.

This structural change is effected so as to minimize any impedance discontinuity that may occur because of the sudden change in dielectric, (from air to plastic). The signal terminals 313 are narrowed while a rectangular window 320 is formed in the ground shield terminals 314. These changes increase the edge coupling physical distance and reduce the broadside coupling influence in order to compensate for the change in dielectric from air to plastic. In the area of the window, a portion of the metal of the large ground shield terminal is being replaced by the plastic dielectric in the window area and in this area, the widths of the signal terminals 313 are reduced to move their edges farther apart so as to discourage broadside coupling to the ground shield terminal and drive edge coupling between the differential signal terminals 313. This increase in edge spacing of the signal terminals 313 along the path of the open window 320 leads the differential signal terminal pair to perform electrically as if they are spaced the same distance apart as in their regular width portions. The spacing between the two narrowed signal terminals is filed with plastic which has a high dielectric constant than does air. The plastic filler would tend to increase the coupling between the signal terminal pair at the regular signal terminal pair edge spacing, but by moving them farther apart in this area, electrically, the signal terminal pair will think they are the same distance apart as in the regular area, thereby maintaining coupling between them at the same level and minimizing any impedance discontinuity at the mounting areas Each ground terminal 314, as shown, is backed with a vertical plastic rib 324. These ribs 324 provide support during the manufacturing process and also provide a dielectric member between the ground terminal and any signal terminal pair facing it in an adjacent wafer. The backing ribs 324 preferable have a width that ranges from between about 60% to about 75% of the ground terminal with a width of about 65% being the most preferred width.

As noted with respect to the embodiments shown in FIG. 8B, the ground terminal 314 is longer (widthwise) that its pair of adjacent or facing pair of signal terminals 313. For example the signal terminals may each have a width of about 0.5 mm and separated by a spacing of 0.3 mm for a combined width of about 1.3 mm, while the ground terminal associated with that signal terminal pair may have a width of about 1.7 to 1.75 mm. Thus, it is preferable that the ground terminal have a width that is at least about 50% greater than the combined width of the two signal terminals, and preferably about 705 to 75% greater. As stated earlier, this arrangement of ground terminals provide a means of inducing or driving the differential signal terminal pair into differential mode coupling, i.e. between the two signal terminals of the pair in a edge coupling fashion while reducing any differential mode coupling with any other signal terminal pairs to a minimum.

Referring back to FIG. 23B, the crosswise bars 322 serve to space the terminal arrays of the wafer halves apart from each other to provide an air dielectric spacing there between an the ribs, primarily the top and bottom ribs defining the upper and lower limits of the air spacing or passage between the terminals. The center rib 322 has a width that is less than that of the top and bottom ribs so that there is no continuous air passage through the connector housings from the terminal tail portions to the contact portions. Rather there is an air passage in the form of an oval, as shown by the arrows "AP" in FIG. 23B defined between the two terminal arrays on the wafer. The wafer may further include one or more notches 330 formed in the sides of the wafer halves in order to provide likewise openings to this internal oval passage. It is preferred, but not necessary to locate the middle rib 322 in the approximate center (heightwise) of the body portions of the connector, meaning approximately halfway along line "BP" of FIG. 23B.

While the preferred embodiment of the invention have been shown and described, it will be apparent to those skilled in the art that changes and modifications may be made therein without departing from the spirit of the invention, the scope of which is defined by the appended claims.

We claim:

1. A mezzanine connector, comprising:

a shroud having a front mating face and an open rear face, the housing including a plurality of terminal-receiving passages, the passages being arranged in columns and rows;

at least one connector unit received in the shroud, the at least one connector unit including a support frame supporting a linear array of conductive terminals, the array including a first and second row of the terminals, said rows of terminals being spaced apart the support frame including a base frame member extending proximate to a mounting face of the at least one connector unit and a vertical front spoke spaced apart from the base frame member and extending proximate to a mating face of the at least one connector unit;

the terminals each including tail portion for mounting to a circuit board, a contact portion for mating with an opposing connector and body portion interconnecting the tail portion and contact portion together, the terminals including pairs of signal terminals and ground terminals, the pairs of signal terminals being aligned edge-to-edge as differential signal terminal pairs within their terminal body portions and within each of first and second row, the differential signal terminal pairs being separated from each other within each of the first and second row by one of the ground terminals, each ground terminal in the first row being spaced apart from and facing a differential signal terminal pair in the second row, and each ground terminal in the second row being spaced apart from and facing a differential signal terminal pair in said the first row, each of the ground terminals having a first width the is greater than a second width of the differential signal terminal pair, the second width corresponding to an outside edge to edge width of the differential signal terminal pair, the ground terminals extending within the connector unit from the base frame member to the vertical front spoke so that the ground terminals cooperatively act electrically as a single ground shield in a serpentine pattern within the first and second row of terminals;

the support frame further being formed in two halves, each of the first and second row of terminals being supported by one of the two halves, the support frame halves spacing the first and second row of terminals apart from each other, widthwise, within the at least one connector unit.

2. The connector of claim 1, wherein the first width is at least about 15% greater than the second width.

3. The connector of claim 2, wherein the first width is at least about 35% greater than the second width.

4. The connector of claim 1, wherein each of said terminal contact portions include a pair of contact arms.

5. The connector of claim 1, wherein crosstalk between an aggressor and a victim differential signal terminal pair within the connector unit does not exceed 3% at a 33 picosecond rise time.

6. The connector of claim 1, wherein said support frame includes a plurality of insulative ribs that extend adjacent to and behind each of ground terminals from the support frame base member to the vertical front spoke.

7. The connector of claim 6, wherein the plurality of ribs have a width that does not exceed a the first width of the ground terminals.

8. The connector of claim 6, wherein the plurality of ribs have a width that is approximately 60-75% of the first width.

9. The connector of claim 1, wherein the support frame includes at least one rib extending widthwise within each connector unit, the at least one rib being interposed between the base frame members and the vertical front spoke, the at least one rib further defining a two-part air channel between the first and second row of terminals.

10. The connector of claim 9, wherein the at least one rib provides a spacer interposed between the first and second row of terminals.

11. The connector of claim 9, wherein the air channel has an oval-like configuration.

12. The connector of claim 9, wherein the support frame includes at least one notch disposed therein that communicates with the air channel.

13. The connector of claim 12, wherein the at least one notch is disposed on a side of the support frame.

14. The connector of claim 9, wherein the support frame includes a pair of notches disposed along the sides of the support frame, the notches communicating with the air channel.

15. A mezzanine connector with a mating face and a mounting face, comprising:

a shroud;

a plurality of support frames that each form a connector unit and are supported by the shroud, each of the support frames being formed in a first and second half including a base frame member extending proximate to a mounting face of the connector unit and a vertical front spoke spaced apart from the base frame member and extending proximate to a mating face of the connector unit, wherein the support frame includes at least one rib extending widthwise, the at least one rib being interposed between the base frame member and the vertical front spoke, the at least one rib further defining a two-part channel between the first and second row of terminals; and an array of conductive terminals in each of the support frames, each array including a first and second row of the terminals, the first and second row of terminals being spaced apart from each other and respectively supported by the first and second half, the terminals including tail portions for mounting to a circuit board, contact portions for mating with an opposing connector and body portions interconnecting the terminal tail and contact portions together, each of the first and second row of terminals being divided into pairs of signal terminals and ground terminals, each of the pair of signal terminals being aligned edge-to-edge as differential signal terminal pair within the terminal body portion and within each of the first and second row the differential signal terminal in the first row facing a differential signal terminal pair in the second row and each ground terminal in the second row facing a differential signal terminal pair in the first row, each of the ground terminals having a first width that is greater than a second width of the differential signal terminals pair that the ground terminal faces, the second width corresponding to an outside edge to edge width of the differential signal terminal pair.

16. The connector of claim 15, wherein the ground terminals cooperatively act electrically as a single ground shield in a serpentine pattern within the two terminal rows.

17. The connector of claim 15, wherein the first width is at least 15% greater than the second width.

18. The connector of claim 15, wherein crosstalk between an aggressor differential signal terminal pair and a victim differential signal terminal pair does not exceed 3% at a 33 picosecond rise time.

19. The connector of claim 15, wherein the support frame includes a rib that extends transverse to the terminals and defines an air channel between the first and second row of terminals.

* * * * *